US005417370A

United States Patent [19]

Kah, Jr.

[11] Patent Number: 5,417,370

[45] Date of Patent: May 23, 1995

[54] TRANSMISSION DEVICE HAVING AN ADJUSTABLE OSCILLATING OUTPUT

[76] Inventor: Carl L. C. Kah, Jr., 778 Lakeside Dr., North Palm Beach, Fla. 33408

[21] Appl. No.: 932,470

[22] Filed: Nov. 18, 1986

[51] Int. Cl.[6] ..... B05B 3/16

[52] U.S. Cl. ..... 239/242; 74/354; 74/384

[58] Field of Search ..... 239/205, 206, 240, 242; 74/25, 31, 354, 384

[56] References Cited

U.S. PATENT DOCUMENTS 1,185,717 6/1916 Roberts ..... 74/354
2,046,412 7/1936 Reynolds ..... 74/354
3,107,056 10/1963 Hunter ..... 239/206
3,713,584 1/1973 Hunter ..... 239/206
4,220,284 9/1980 Beiswenger et al. ..... 239/242
4,568,024 2/1986 Hunter ..... 239/242

*Primary Examiner*—Andres Kashnikow
*Attorney, Agent, or Firm*—Jack N. McCarthy

[57] ABSTRACT

A transmission device having an input shaft and oscillating output gear with an oscillating connection therebetween. The oscillating connection comprising a pivoted gear cage with oppositely rotatable driving gears, the gear cage having a mechanism to pivot it to connect the input shaft and output gear alternately with the driving gears. The oscillating output gear having an adjustment to control the angle of oscillation. A liquid can be directed through the transmission to an oscillating nozzle.

162 Claims, 10 Drawing Sheets

TRANSMISSION DEVICE HAVING AN ADJUSTABLE OSCILLATING OUTPUT

TECHNICAL FIELD

This invention relates to transmission devices having a rotary input shaft and oscillating output shaft, including a device to change the angle of oscillation, such as used in rotary sprinkler heads for irrigation.

Background Art

Oscillating transmission devices have been known in the prior art for use in rotary sprinkler heads for irrigation. Patents setting forth a background for this invention are U.S. Pat. Nos. 3,724,757; 3,713,584; 3,107,056; and 4,568,024.

Disclosure of Invention

An object of this invention is to have a transmission for alternately driving an output gear to oscillate it, by one driving gear and then another, with spring means being provided to prevent the transmission from being placed in an "off" position with neither driving gear positioned to drive the output gear upon starting.

Another object of this invention is to have an oscillating transmission with a pivoted gear cage having two drive gears, a first clockwise drive gear and a second counter-clockwise drive gear, for alternate driving engagement with an output gear to oscillate it, a first and second overcenter spring means act on said gear cage in one direction to place one drive gear into driving engagement with said output gear while placing said other drive gear out of driving engagement. To reverse the position of the drive gears, the first spring means has its biasing force removed from the gear cage to be placed in an overcenter position to bias the gear cage in the opposite direction so that the other drive gear can be placed in driving engagement with said output gear and the one drive gear can be placed out of driving engagement, said second spring means retaining the one drive gear in driving engagement until the first spring means is biasing the gear cage to the reverse position and has overcome the second spring means to place it in an overcenter position; the second spring means thus acts together with the first spring means to pivot said gear cage to its reverse position. The second overcenter spring means insures that during the time that the pivoted gear cage is not being biased by the first overcenter spring means that it remains in one driving position or the other, and cannot be left in a "dead-center" position where neither of the two drive gears is in driving engagement with said output gear.

A further object of this invention is to provide an oscillating transmission which has an angular positioning member for directly setting the oscillating angle and a shaft with an adjusting, or setting, slot accessible on the top of an oscillating output cap. The slot has an arrowhead at one end indicating the position of an adjustable reversing actuator within the transmission, and an arrowhead is placed on the top of the output cap indicating the position of a fixed reversing actuator within the transmission. Indicia representing angles can be placed around the output cap to aid in positioning the setting slot at a desired angle. The ability to look at the adjustable angular selection dial and see at a glance what arc a particular unit is set for, provides an enhanced marketability for products using this drive, especially in the sprinkler field. When used as a sprinkler device, the sprinkler devices can be removed from a lawn location for cleaning or inspection and when it is desired to reinstall the sprinkler device, the desired angle of oscillation can easily be set by simply looking at the top of the device and if it is not already properly set, a rotatable member can be pointed at the desired angle position indicated on the top of the sprinkler device.

Another object of this invention is to provide for a driving connection between a rotating input shaft and an output gear for oscillating the output gear and providing for changing the angle of oscillation. The output gear has a fixed projection thereon to reverse rotation at one side of the angle and a cylindrical member mounted for rotation with said output gear has an adjustable projection to reverse rotation at the other side of this angle, relative rotation of said cylindrical member with said output gear changing said angle of oscillation.

A further object of this invention is to provide an oscillating transmission having a ring gear mounted for rotation with means for oscillating said ring gear; a toggle means reverses the rotation of said ring gear from one direction to the other, with contact means rotated by said ring gear engaging said toggle means to reverse rotation from one direction to the other, said contact means are two projecting members, with means mounting said two projecting members for relative movement to vary the angle at which said toggle means is actuated, said one projecting member being mounted on said ring gear while said other projecting member is mounted for rotation within said ring gear. Means connect said other projecting member to said ring gear for being driven thereby to contact said toggle means to reverse rotation of said ring gear, and means disconnect said other projecting member from said ring gear when said other projecting member is rotated to vary the angle between the projecting members.

An object of this invention is to provide a transmission having an oscillating output ring gear with a hollow shaft at the center thereof, said oscillating hollow shaft providing the output of the transmission such as by a gear attached thereto, a cylindrical member being mounted for rotation with said hollow shaft, an adjustable projection extending from said cylindrical member to serrations on the interior of said ring gear for contacting an actuating means to reverse transmission direction, said serrations connecting said adjustable projection to said ring gear for being driven thereby, said serrations providing for relative movement when said cylindrical member is rotated to vary the angle of rotation; said cylindrical member can be rotated directly through the hollow shaft.

Another object of this invention is to provide a torque-limiting member between said cylindrical member and said hollow shaft for providing for rotation of said cylindrical member without placing undue forces on any other operating parts.

Another object of this invention is to provide an oscillating transmission having an oscillating ring gear with a hollow shaft at the center thereof, said oscillating hollow shaft providing the output of the transmission, a nozzle head oscillated by said ring gear for receiving a flow of water through said transmission.

A further object of this invention is to provide an improved oscillating drive having a reversing gear cage and toggle device mounted on a base member for oscillation, said gear cage having two spaced driving gears always engaging an output gear with one spaced driving gear having an idler gear, either driving gear is driven by a spur gear on an input shaft located in the space between one driving gear and idler gear to drive the output gear, said input shaft extending through said space from said base member with a sleeve therearound with said gear cage having an elongated opening around said sleeve, the length of the elongated opening determining the engagement of the teeth of the spur gear with its cooperating driving gear or idler gear to prevent excessive or unnecessary interaction between the gears.

Another object of this invention is to provide an improved oscillating drive having a reversing gear cage wherein said gear cage is alternately biased by first biasing means in one or the other of two driving positions to provide for oscillating movement, second means being provided for biasing said gear cage in one of said directions to maintain a driving engagement when said first biasing means has been removed.

A further object of this invention is to provide an improved oscillating drive having a reversing gear cage with two spaced driving gears always engaging an output gear; either driving gear is driven by an input shaft, located in the space between the driving gears, to drive the output gear; the reaction force on the driving gear tends to hold the reversing gear cage and driving gear into engagement with the input shaft.

Another object of this invention is to provide an improved oscillating drive having a toggle device mounted on a base member for oscillation, stops are provided between said toggle device and base member for (1) limiting the biasing load on gears during operation; and (2) providing ease of spring insertion during assembly.

An object of this invention is to have a spring biased toggle device mounted for rotation on a base member with springs acting radially outward from said base member with an increased effective lever arm.

BEST MODE FOR CARRYING OUT THE INVENTION

Figure 1:
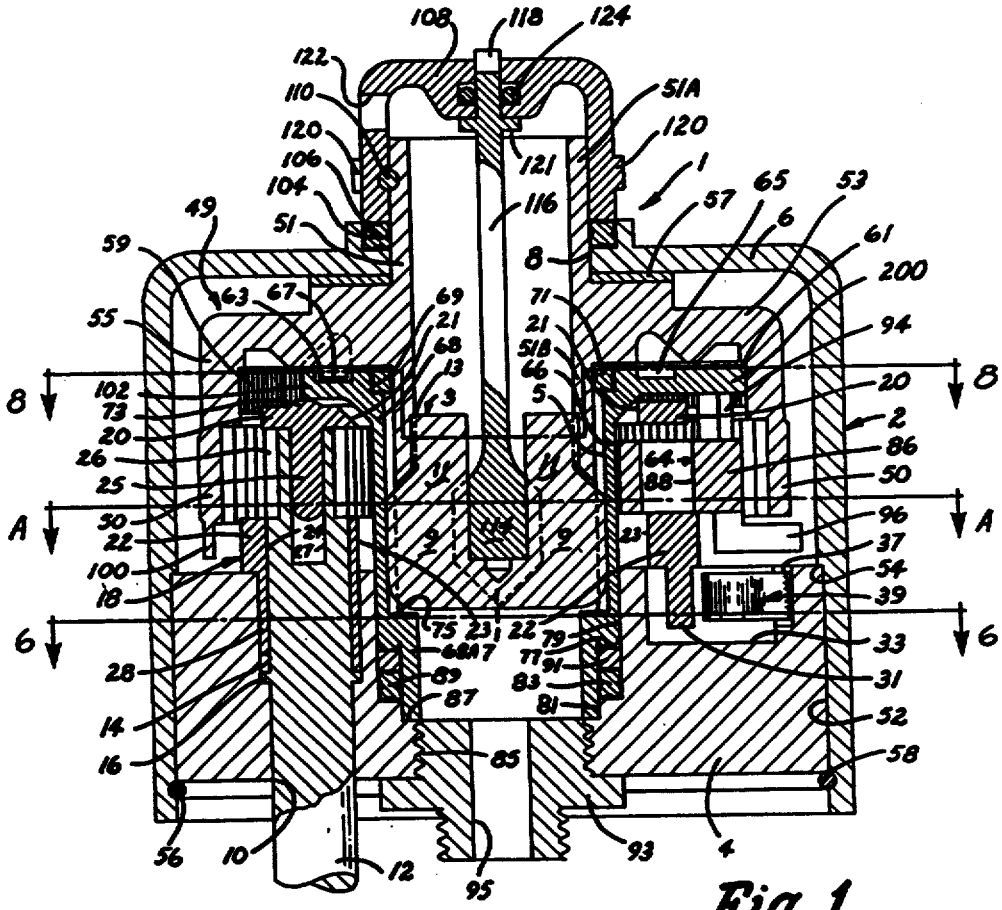
FIG. 1 is an elevational view in section of a transmission device showing the input drive shaft and output cap, the reversing gear cage and reversing toggle being positioned as shown in FIG. 8, with the reversing gear cage spring means shown in full where it engages the base member.

Referring to FIG. 1 of the drawings, a transmission device 1 is shown having a cylindrical housing 2 positioned over and fixed to a base member 4. Cylindrical housing 2 has an integral cover 6 having a center outlet opening 8 for a purpose to be hereinafter described. The end of cylindrical housing 2 over base member 4 has a circumference of an increased inner diameter 52 forming an annular step 54. Base member 4 is positioned in the increased diameter 52 of cylindrical housing 2 against the annular step 54 and an internal snap ring 56 is placed in an annular groove 58 in the circumference of increased inner diameter 52 formed at the bottom of base member 4 to fix it in place. Other holding means can be used.

Base member 4 has an opening 10 therethrough positioned to one side for receiving a rotary input shaft 12. Rotary input shaft 12 can be driven by any means desired, such as an electric motor, manual means, fluid turbine, etc. The upper part 14 of the opening 10 is enlarged to receive an annular flange 16 on the input shaft 12. A reversing gear cage 18 is positioned within said cylindrical housing 2 adjacent said base member 4 and the reversing gear cage 18 is formed having a top plate 20 and a bottom plate 22 with cooperating center openings 21 and 23, respectively. The bottom plate 22 has an opening 24 therein to receive the rotary input shaft 12, the upper end of which is formed as a spur gear 26. A cylindrical shaft 28 extends downwardly from the bottom of the bottom plate 22 around opening 24 and extends into the upper part 14 of the opening 10 to provide for pivotal movement of the reversing gear cage 18 while the cylindrical shaft 28 properly positions the input shaft 12 and spur gear 26 above the top of the bottom plate 22 by enclosing the annular flange 16. An integral shaft 25 extends downwardly from the bottom of top plate 20 to engage a cylindrical opening 27 extending downwardly from the top of input shaft 12 through the centerline of the spur gear 26.

Figure 3:
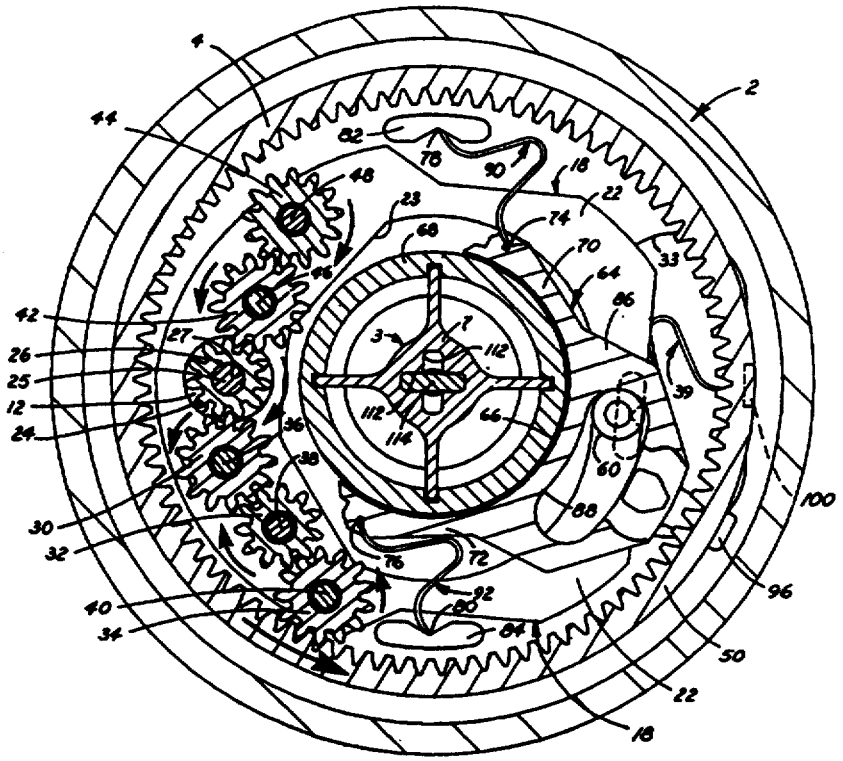
FIG. 3 is a transverse sectional view of the transmission device taken along a plane represented by the line A—A of FIG. 1 showing the reversing gear cage and reversing toggle, each biased clockwise to one side with a driving gear of the reversing gear cage engaging the ring gear on the output member for counter-clockwise drive.
Figure 4:
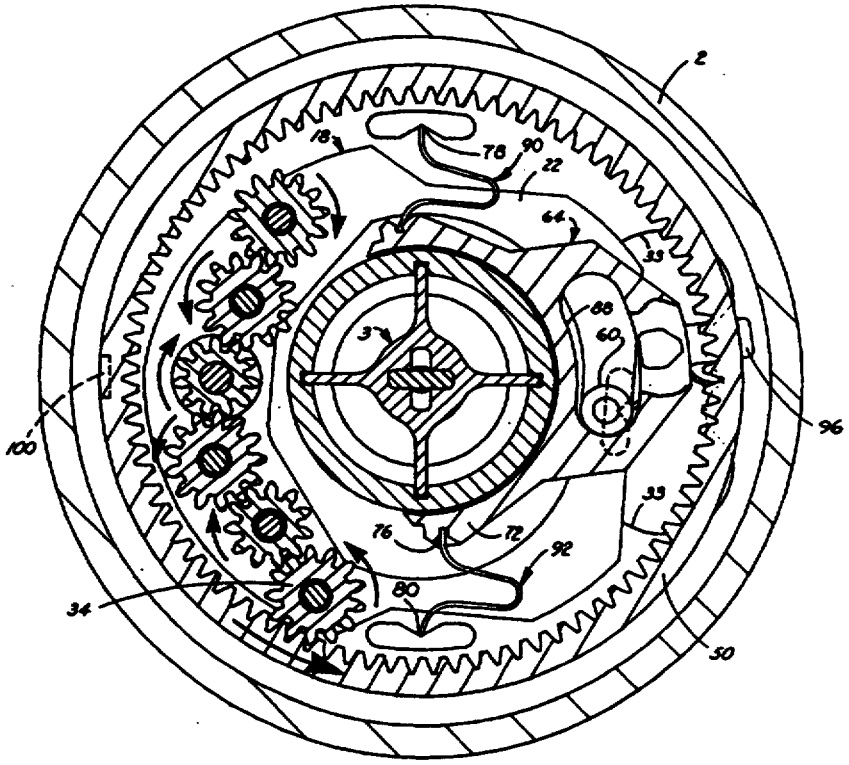
FIG. 4 is a transverse sectional view of the transmission device taken along a plane represented by the line A—A of FIG. 1 showing the reversing toggle forced counted-clockwise to a position where the reversing toggle has just passed over a center line reversing the biasing forces on said reversing toggle.
Figure 5:
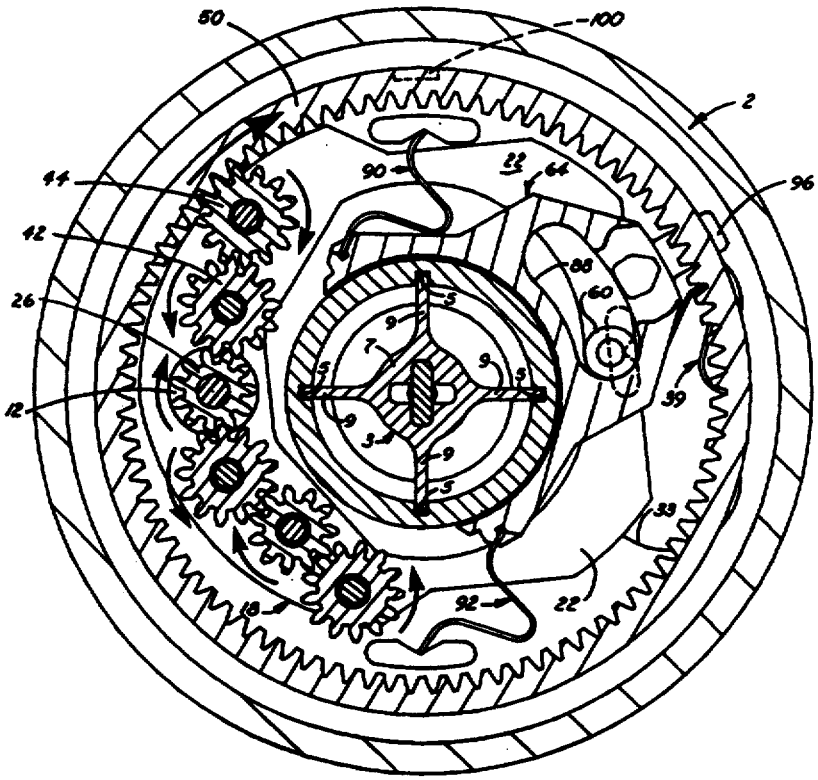
FIG. 5 is a transverse sectional view of the transmission device taken along a plane represented by the line A—A of FIG. 1 showing the reversing gear cage and reversing toggle, each biased counter-clockwise to the other side with an opposite driving gear of the reversing gear cage engaging the ring gear on the output member for clockwise drive.

As shown in FIGS. 3, 4 and 5, three gears 30, 32 and 34 are mounted on integral shafts 36, 38 and 40 extending downwardly from top plate 20 of the reversing gear cage 18 and they extend in a counter-clockwise direction from the integral shaft 25. Integral shaft 36 is positioned so that gear 30 will engage the spur gear 26; shaft 38 is positioned so that gear 32 will engage gear 30; and shaft 40 is positioned so that gear 34 engages gear 32 and extends outwardly over the edges of top plate 20 and bottom plate 22 so that it can drivingly engage an output ring gear 50, encircling the reversing gear cage 18 between the top plate 20 and bottom plate 22. Output ring gear 50 is formed as a part of output member 49. Output member 49 will be hereinafter discussed as to its structure and use.

Two gears 42 and 44 are mounted on integral shafts 46 and 48 extending downwardly from top plate 20 of the reversing gear cage 18 and they extend in a clockwise direction from the integral shaft 25. Integral shaft 46 is positioned so that gear 42 will engage the spur gear 26 and shaft 48 is positioned so that gear 44 engages gear 42 and extends outwardly over the edges of top plate 20 and bottom plate 22 so that it can drivingly engage said output ring gear 50. Integral shafts 36, 38, 40, 46 and 48 of top plate 20 extend into matched openings in bottom plate 22 and have a snap engagement at their ends with said openings to fix said top plate 20 and bottom plate 22 of the reversing gear cage 18 together.

A hollow actuating post 60 extends upwardly from the top of the bottom plate 22 at a point on the other side of the center opening 23 from the opening 24, and on a radial line passing through the center of the opening 24; said arrangement permits arcuate movement of hollow actuating post 60 about the center of opening 24, cylindrical shaft 28, and spur gear 26, as reversing gear cage 18 is moved between its clockwise driving position and counter-clockwise driving position. A short integral shaft 62 extends downwardly from the bottom of top plate 20 to have snap engagement with the hollow actuating post 60.

It can be seen that when the reversing gear cage 18 is positioned clockwise around input shaft 12, as shown in FIG. 3, the gear 34 is engaging the ring gear 50. With the rotary input shaft 12 being driven clockwise, the two idler gears 30 and 32 will rotate drive gear 34 counter-clockwise, imparting a counter-clockwise rotation to output ring gear 50. When the reversing gear cage 18 is positioned counter-clockwise around input shaft 12, as shown in FIG. 5, the gear 44 is engaging the ring gear 50. With the rotary input shaft 12 being driven clockwise, the one idler gear 42 will rotate the drive gear 44 clockwise, imparting a clockwise rotation to output ring gear 50.

To bias the reversing gear cage 18 in a clockwise direction to have gear 34 engage ring gear 50, or bias the reversing gear cage 18 in a counter-clockwise direction to have gear 44 engage ring gear 50 for oscillating movement of output ring gear 50, a reversing toggle device 64 is positioned between the top plate 20 and bottom plate 22 of reversing gear cage 18. The reversing toggle device 64 is formed having a C-shape with an arcuate inner surface 66 greater than 180° for rotation about a cylindrical member 68, extending through the center openings 21 and 23 of top plate 20 and bottom plate 22 of reversing gear cage 18. Cylindrical member 68 will be hereinafter discussed as to its structure and use.

The C-shape of reversing toggle device 64 has two arms 70 and 72 with spring seat notches on their outer surface at 74 and 76, respectively; said spring seat notches 74 and 76 being 180° apart. Cooperating spring seat notches 78 and 80 are placed on projections 82 and 84, extending upwardly from the top surface of base member 4, adjacent the gear teeth of output ring gear 50. The spring seat notches 78 and 80 are located on a diametrical line through the centerline of the cylindrical housing 2, said diametrical line being 90° to a line passing between the center of opening 24 of bottom plate 22 and the centerline of the cylindrical housing 2.

An overcenter spring means 90 extends between spring seat notch 74 on reversing toggle device 64 and spring seat notch 78 on projection 82 of base member 4, and a cooperating overcenter spring means 92 extends between spring seat notch 76 on reversing toggle device 64 and spring seat notch 80 on projection 84 of base member 4. Spring means 90 and 92 bias reversing toggle device 64 in a clockwise direction as viewed in FIG. 3, and in a counter-clockwise direction as viewed in FIG. 5. The action of these spring means 90 and 92 reverses when seat notches 74 and 76 pass on either side of a centerline passing through the spring seat notches 78 and 80.

Reversing toggle device 64 has a relatively wide radial arm 86 extending outwardly from the center portion thereof between the arms 70 and 72, to a location spaced inwardly from the gear teeth of ring gear 50. An arcuate opening 88 is placed in said radial arm 86 at a radius to receive the hollow actuating post 60 of the reversing gear cage 18.

Movement of toggle device 64 in either clockwise or counter-clockwise direction to just over its centerline position, reverses the biasing direction of each overcenter spring means 90 and 92, changing the biased position of toggle device 64. Toggle device 64 has an end of arcuate opening 88 which contacts hollow actuating post 60 to bias the reversing gear cage 18 in the same direction as the toggle device 64 changing the reversing gear cage 18 drive connection to output ring gear 50. It can be seen that this movement of toggle device 64 controls movement of reversing gear cage 18 between clockwise and counter-clockwise movement.

The radial arm 86 of reversing toggle device 64 has an upstanding projection 94 for rotating said toggle device 64 in a counted-clockwise direction and an outwardly extending radial projection 96 for rotating said toggle device 64 in a clockwise direction to move it to the overcenter position where the overcenter spring means 90 and 92 take over and bias the toggle device 64 and, in turn, reversing gear cage 18 to its engaged position with output ring gear 50. Upstanding projection 94 extends upwardly from the end of the top of radial arm 86 to a point above the teeth of the ring gear, and the outwardly extending radial projection 96 extends from the bottom of the radial arm 86 and under the output ring gear 50 adjacent its lower edge. Actuation of projection 94 and 96 will be hereinafter described.

To maintain a biasing force on reversing gear cage 18 at all times, to keep a driving gear 34 or 44 into engagement with ring gear 50, a downwardly projecting member 31 is located on the bottom of bottom plate 22 of the reversing gear cage 18 and extends into a recess 33 formed in the top of base member 4. Downwardly projecting member 31 is positioned below the actuating post 60 with a spring seat notch 35 facing outwardly along a radial line through the center of cylindrical shaft 28. A cooperating spring seat notch 37 is positioned on the outer wall of recess 33 on a line passing through the center of cylindrical shaft 28 and the center of the cylindrical housing 2. An overcenter spring means 39 extends between spring seat notch 35 on downwardly projecting member 31 and spring seat notch 37 on the outer wall of recess 33. Overcenter spring means 39 (and spring means 90 and 92) are formed from ribbon-like spring material, for example, steel, and shaped with an intermediate arcuate portion and oppositely directed straight portions to engage spring seat notches. Each end of the straight portions have serrations 41 to grip the spring seat notches. Overcenter spring means of this type, and others, are shown in U.S. Pat. Nos. 3,713,584; 3,724,757; and 3,107,056. Other types of overcenter spring means can be used. The biasing force of overcenter spring means 39 is made less than the combined biasing force of overcenter spring means 90 and 92, so that overcenter spring means 39 will only maintain the driving gear of reversing gear cage 18 in engagement until the overcenter spring means 90 and 92 actually go over center and force the toggle device 64 to the other side, the toggle device 64 contacting the actuating post 60 of the reversing gear cage 18 to carry the reversing gear cage 18 with it, breaking loose the driving gear from ring gear 50, at which time spring means 90 and 92 overpower the spring means 39, carrying the gear cage 18 over center to reverse the biasing force of spring means 39, spring means 90, 92, and 39, biasing the opposite driving gear of gear cage 18 into engagement. This prevents the reversing gear cage 18 from becoming positioned with both drive gears 34 and 44 out of engagement with ring gear 50. The reversing gear cage spring means 39 thus ensures that the drive gear of the reversing gear cage 18 remains engaged with ring gear 50 during stopping and starting torque changes through the range of rotational arcs where the gear cage 18 is not biased by the toggle device 64 loading against post 60 to hold the drive train in engagement.

Output ring gear 50 and cylindrical member 68 are mounted for rotation with each other in cylindrical housing 2 in either a clockwise or counter-clockwise direction. A fixed projection 100 extends downwardly from the bottom edge of output ring gear 50 to contact the outwardly extending radial projection 96 when ring gear 50 is being driven in a clockwise direction by gear 44 of reversing gear cage 18 (see FIG. 5). This movement of radial projection 96, as described hereinbefore, moves toggle device 64 just over its centerline position and spring means 90 and 92 take over as the driving engagement of gear 44 is broken and spring means 90 and 92 overpower the reversing gear cage biasing spring means 39, to bias toggle device 64 and reversing gear cage 18 to its opposite position to engage gear 34 and drive ring gear 50 in a counter-clockwise direction (see FIG. 3).

Figure 8:
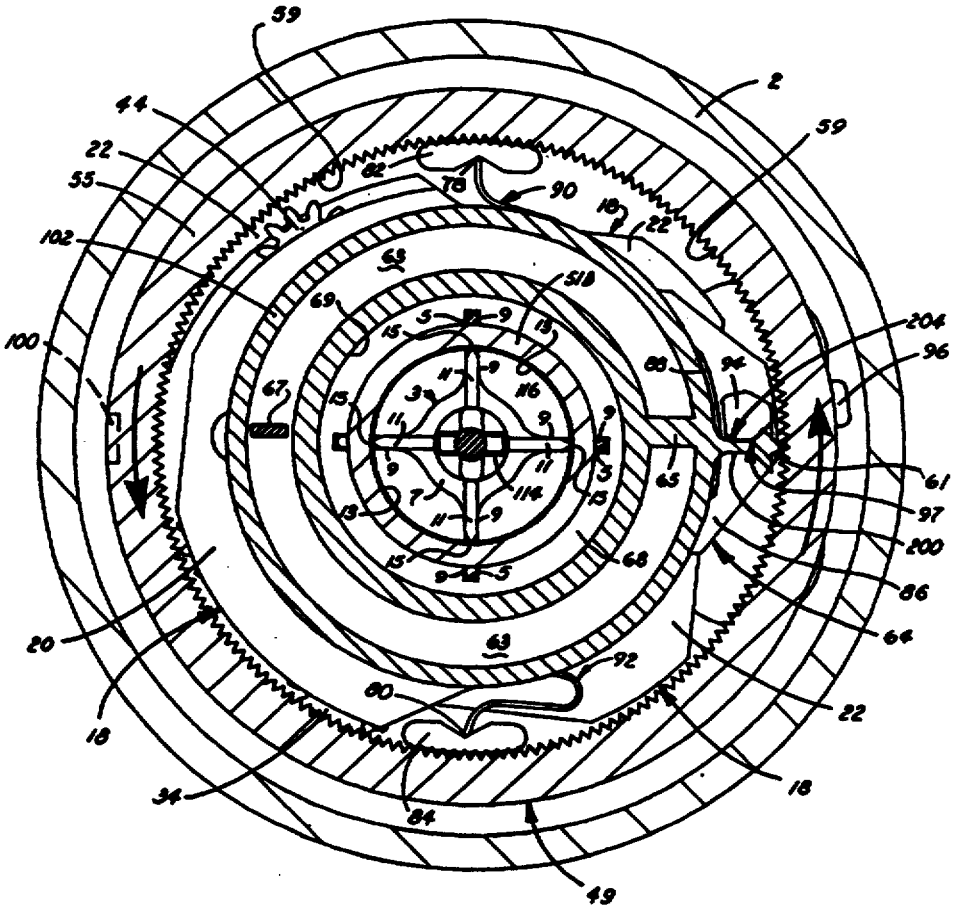
FIG. 8 is a transverse sectional view of the transmission device taken along the line 8—8 of FIG. 1 with the seal removed between the cooperating cylindrical member and output member, the position of the reversing gear cage and reversing toggle being the same as shown in FIG. 1 and FIG. 4.
Figure 9:
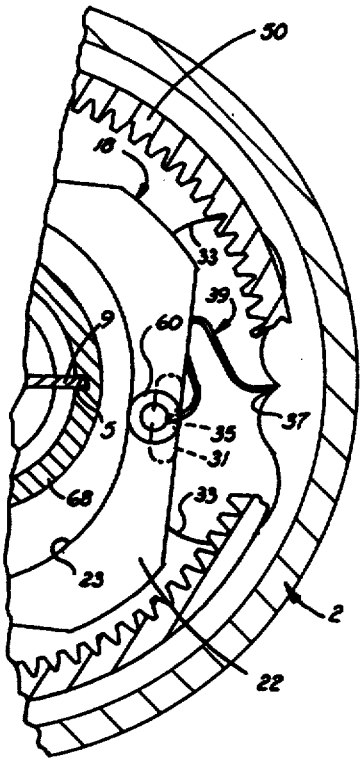
FIG. 9 is a fragmentary view of the right side of FIG. 3, with the toggle device removed and a portion of the ring gear broken away, to show the relation of the actuating post and downwardly projecting member of the reversing gear cage and gear cage overcenter spring means.
Figure 10:
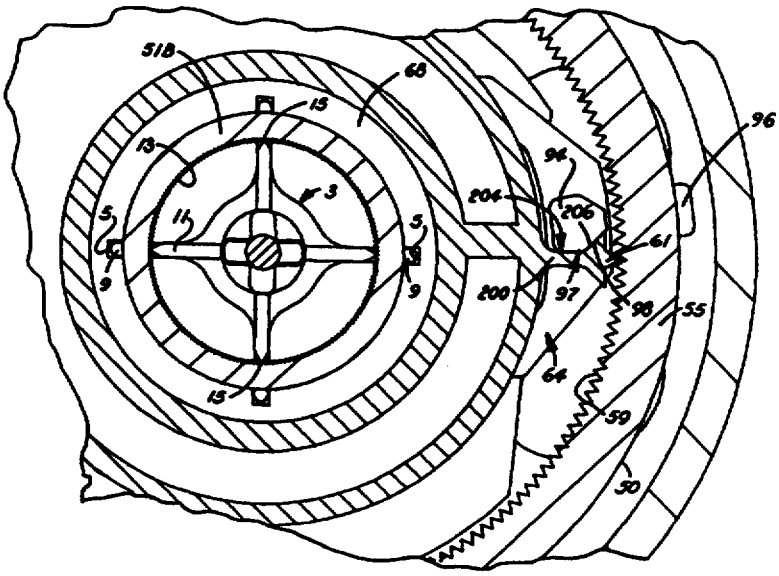
FIG. 10 is an enlarged view of the center part of FIG. 8, along with the angular adjustable radial projection, showing the connecting serrations.
Figure 12:
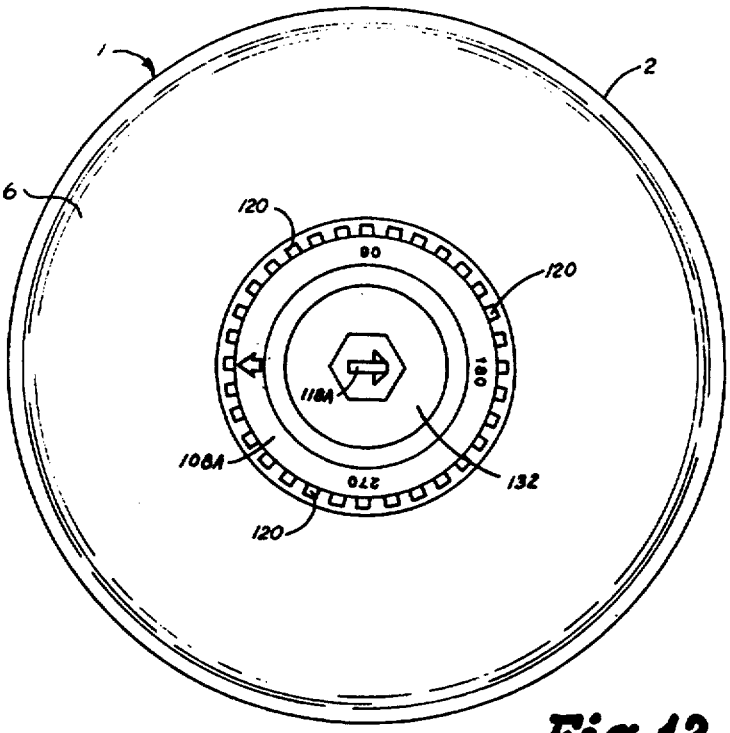
FIG. 12 is a top view of the modified transmission device of FIG. 11.

An angularly adjustable radial projection 200 extends radially from an annular flange 102 on top of cylindrical member 68 to contact the upstanding projection 94 of toggle device 64 when ring gear 50 and annular flange 102 are being driven in a counter-clockwise direction by gear 34 of reversing gear cage 18 (see FIG. 3 ). This movement of upstanding projection 94, as described hereinbefore, moves toggle device 64 just over its centerline position and spring means 90 and 92 take over, as the driving engagement of gear 34 is broken and spring means 90 and 92 overpower the reversing gear cage biasing spring means 39, to bias toggle device 64 and reversing gear cage 18 to its opposite position to engage gear 44 and drive ring gear 50 in a clockwise direction (see FIG. 8 where adjustable radial projection 200 is about to move the upstanding projection 94 over its centerline position). The cooperation between ring gear 50 and annular flange 102 will be hereinafter described.

Output member 49 includes a cylindrical shaft member 51 with a radial flange 53 extending outwardly from a midportion thereof. A cylindrical flange 55 extends downwardly from the end of the radial flange 53, with output ring gear 50 being formed at the bottom thereof. Cylindrical shaft member 51 has an upper hollow output shaft portion 51A extending upwardly through opening 8 to the exterior of the cover 6 and a lower cooperating cylindrical portion 51B extending into cylindrical member 68.

The upper hollow output shaft portion 51A forms an annular groove 104 with the top of cover 6. An annular resilient sealing member 106 is located in said groove 104. An output cap 108 is placed over the end of upper hollow output shaft portion 51A with its lower end enclosing the annular resilient sealing member 106. The output cap 108 is fixed to the upper hollow output shaft portion 51A by a pin 110. Other desired fixing means can be used.

The upper surface of radial flange 53 of output member 49 has a raised portion adjacent said upper hollow output shaft portion 51A on which a thrust washer 57 is placed to engage the inner surface of integral cover 6. The lower surface of radial flange 53 has a cooperating contour with the top surface of annular flange 102 on the top of cylindrical member 68 to limit the angular movement between the mating flanges 53 and 102.

An annular notch 69 is formed in the inner end of annular flange 102 facing the lower surface of radial flange 53 and upper part of cylindrical portion 51B. An annular resilient sealing member 71 is positioned in annular notch 69 to seal the gear housing from pressure in the annular passage through the central shaft area.

A slight rounded projection 73 extends from the top of top plate 20 of reversing gear cage 18 over integral shaft 25 to properly space it from the bottom of annular flange 102.

An annular groove 63 is placed in the top surface of annular flange 102, with an integral stop member 65 being placed therein. Said integral stop member 65 is positioned in said annular groove 63 a few degrees counter-clockwise of the adjustable radial projection 200 (see FIG. 8). A cooperating stop projection 67 extends downwardly from the lower surface of radial flange 53 and projects into the annular groove 63. It can be seen that flanges 102 and 53 have a relative angular movement of approximately 360°, the arc of travel of stop projection 67 in annular groove 63 from one side of integral stop member 65 to the other.

A plurality of serrations 59 extend around the inner circumference of cylindrical flange 55 between the radial flange 53 of output member 49 and the internal teeth of ring gear 50. Serrations 59 are positioned to engage an angular holding pointer 61 on the adjacent end of angularly adjustable radial projection 200.

The lower part of cylindrical member 68 is formed having a smaller cylindrical section 68A, said smaller cylindrical section 68A forming an inner annular step 75 where it meets the upper larger portion of cylindrical member 68, and an outer rounded step 77. To receive the lower end of cylindrical member 68 and smaller cylindrical section 68A, base member 4 has a second opening 79 therethrough axially aligned with outlet opening 8. Second opening 79 has a small portion 81 of reduced diameter forming an annular step 83, and a small end portion 85 of a further reduced diameter which is threaded forming an annular step 87.

The upper part of cylindrical member 68 engages second opening 79 and smaller cylindrical section 68A engages the reduced diameter of portion 81 with the bottom end of smaller cylindrical section 68A engaging annular step 87. This forms an annular chamber between annular step 83 and outer rounded step 77. An annular resilient sealing member 89 is placed in said chamber against annular step 83, and a seal retaining ring 91 is placed between said sealing member 89 and the rounded step 77. This provides for proper positioning of cylindrical member 68 in cylindrical housing 2 and provides for sealing at that point. An adaptor 93 is threaded in opening 85 having an opening 95 therethrough for directing a liquid, such as water, into cylindrical section 68A, if desired.

An angular positioning member 3 interconnects the lower cooperating cylindrical portion 51B and cylindrical member 68 to set a desired angular position therebetween to control the oscillating angular movement of upper hollow output shaft portion 51A. Said lower cooperating cylindrical portion 51B extends into cylindrical member 68 approximately one-half of the distance to annular step 75. The inner surface of the upper portion of cylindrical member 68 has four equally spaced longitudinal turning grooves 5 extending from the annular notch 69 to the inner annular step 75. Angular positioning member 3 has a centerbody 7 with four equally spaced vane members 9 thereon. The lower portion of the vane members 9 extend into the cooperating grooves 5 from the bottom thereof up to approximately the lower end of lower cooperating cylindrical portion 51B. The vane members 9 are integrally attached to centerbody 7 up to this point. The vane members 9 then taper inwardly and extend upwardly as four individual projections 11 into the lower cooperating cylindrical portion 51B. This cylindrical portion 51B has serrations 13 therearound for engagement by tapered, or pointed, outer ends 15 on projections 11 to connect angular positioning member 3 to cylindrical portion 51B of output member 49.

Centerbody 7 of angular positioning member 3 has crossed slots 112 aligned with vane members 9 to receive the flat paddle 114 of an angular positioning or setting shaft 116. Angular positioning shaft 116 extends through output cap 108, presenting a small adjusting, or setting, slot 118 to the top of the output cap 108; said small slot having an indicating arrowhead at one end indicating the position of the angularly adjustable radial projection 200, while an indicating arrowhead on the output cap 108 indicates the position of the fixed projection 100. An annular flange 121 on angular positioning shaft 116 prevents the flat paddle 114 from becoming accidentally disconnected. A seal 124 extends between the output cap 108 and angular positioning shaft 116.

Gear teeth 120 are located around the output cap 108 to provide an external drive. An opening 122 is provided in output cap 108 to serve as a nozzle opening and it is aligned with the fixed projection 100. Angular degree settings can be inscribed in the top surface of the output cap 108 to set a desired oscillating angle.

In driving operation, input shaft 12 turns clockwise driving output ring gear 50 in an oscillating motion through a predetermined angle set by adjusting slot 118. This angle is shown as 180° in the Figures. Starting from FIG. 3, drive gear 34 is engaged with and drives ring gear 50 counter-clockwise, bringing ad justable radial projection 200 into actuating contact with upstanding projection 94 of toggle device 64, moving toggle device 64 against spring means 90, 92 past an overcenter position reversing the action of spring means 90, 92. This biases toggle device 64 counter-clockwise for engagement with actuating post 60 of gear cage 18. Further movement of ring gear 50 by drive gear 34 continues to move radial projection 200 against upstanding projection 94 which begins to pivot the gear cage 18 against the force of spring means 39, disengaging the drive gear 34. The reversed action of spring means 90, 92 now overcomes the force of spring means 39, moving the spring means 39 past an overcenter position, reversing the action of spring means 39. Spring means 39 and spring means 90, 92 now carry gear cage 18 to its new clockwise driving position (see FIG. 5) with drive gear 44 engaging and driving ring gear 50 clockwise; movement of ring gear 50 clockwise bringing fixed projection 100 into actuating contact with radial projection 96 of toggle device 64, moving toggle device 64 against spring means 90, 92 past an overcenter position, reversing the action of spring means 90, 92. This biases toggle device 64 clockwise for engagement with actuating post 60 of gear cage 18. Further movement of ring gear 50 by drive gear 44 continues to move fixed projection 100 against radial projection 96 which begins to pivot the gear cage 18 against the force of spring means 39, disengaging drive gear 44. The reversed action of spring means 90, 92 now overcomes the force of spring means 39, moving the spring means 39 past the overcenter position, reversing the spring means 39. Spring means 39 and spring means 90, 92 now carry gear cage 18 back to its counter-clockwise position (see FIG. 3) with drive gear 34 engaging and driving ring gear 50 counter-clockwise. This oscillation continues as long as input shaft 12 is driven.

During the driving operation, fixed projection 100 is directly driven by ring gear 50 but angularly adjustable radial projection 200 is driven by ring gear 50 through serrations 59 and 13. Output member 49 has an equal number of serrations 59 and 13 above ring gear 50 and in cylindrical portion 51B, respectively. Angularly adjustable radial projection 200 has the angular holding pointer 61 on its outer end providing a direct driving connection with one serration of serrations 59, so ring gear 50 can drive the angularly adjustable radial projection 200. This angularly adjustable radial projection 200 has a special contour 204 on each side to mate with a contour 97 on upstanding projection 94. As contour 204 is driven against contour 97, the angular holding pointer 61 is held in its proper angle setting serration 59. This action is obtained by an angled surface 206 on the end of angularly adjustable radial projection 200 which extends outwardly in the direction of movement of the ring gear 50 to engage a mating angled surface 98 on upstanding projection 94. These angled surfaces 206 and 98 prevent the angular holding pointer 61 from bending in the direction the serrations 59 are moving and therefore preventing a serration 59 from being pulled over the angular holding pointer 61. This action is employed to self-lock the output cap to its last set position in both clockwise and counted-clockwise directions of movement of ring gear 50.

Angularly adjustable radial projection 200, extending from annular flange 102, has inner cylindrical member 68 providing an indirect driving connection with serrations 13 through which ring gear 50 can drive the annular flange 102 and angularly adjustable radial projection 200. Angular positioning member 3 interconnects lower cooperating cylindrical portion 51B to cylindrical member 68 through serrations 13 in lower cooperating cylindrical portion 51B and cooperating grooves 5 in cylindrical member 68. Tapered, or pointed, outer ends 15 on projections 11 extend into serrations 13 and the ends of vane members 9 extend into the cooperating grooves 5.

Rotation of lower cooperating cylindrical portion 51A turns serrations 13 which then rotate the ends 15 of projections 11 of angular positioning member 3; this rotates vane members 9 and cylindrical member 68 with its radial projection 200. Rotation of cylindrical member 68 through serrations 13 provides for slippage prevention. As lower cooperating cylindrical portion 51A rotates, or drives, angular positioning member 3, the ends of vane members 9 in grooves 5 are dragged slightly rearwardly by cylindrical member 68, placing a slight curve in the ends 15 of projections 11. The serrations 13 push, or bite, into the ends 15 and tend to have a fixed relationship, and prevent slippage and overriding. This arrangement also aids in maintaining the preset angular setting indicated on the output cap 108.

Figure 2:
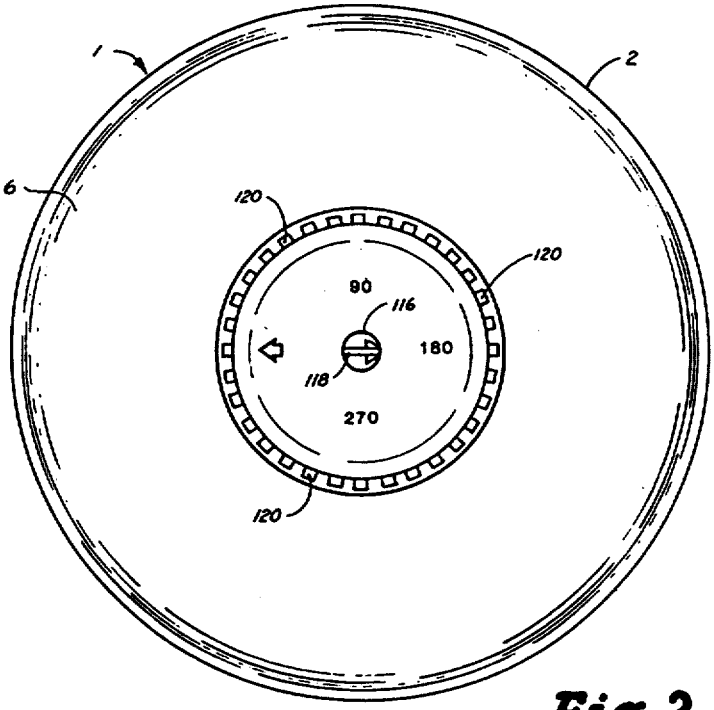
FIG. 2 is a top view of the transmission device of FIG. 1 showing the output cap and oscillating angle selector.

To set the angle between the fixed projection 100 and angularly adjustable radial projection 200, the adjusting slot 118 is observed to note the indicated angular setting. If the new desired angular setting is larger than the indicated setting, the output cap 108 can be held and the slot 118 moved clockwise to the larger desired oscillating angle. In all but one case, the angular setting can be changed by merely holding the output cap 108 and pointing the arrowhead of slot 118 at the changed angle position. That one case is where the angle between adjustable radial projection 200 and upward projection 94 of toggle device 64 will not permit the desired counter-clockwise rotation of slot 118 and shaft 116 to effect the desired reduced angular setting. In this one case, the angle is set as described below for a smaller angular setting. In FIG. 2, if a setting of 270° is desired, since it is set at 180°, the arrowhead of slot 118 would merely be positioned to point at 270°.

Movement of slot 118 rotates setting shaft 116 and flat paddle 114 clockwise. Flat paddle 114 rotates angular positioning member 3 and in turn cylindrical member 68 through vane members 9 and cooperating grooves 5. Tapered outer ends 15 on projections 11 are forced over the serrations 13, aided by bending of vane members 9 by the drag on the ends of vane members 9 in grooves 5, and angular holding pointer 61 on angularly adjustable radial projection 200 is forced over the serrations 59 to a new cooperating position with the serrations for the new angular setting.

If the new desired angular setting is smaller than the indicated setting, the output cap 108 is rotated clockwise as far as it will go with cooperating stop projection 67 engaging integral stop member 65, if it will rotate clockwise at all; if the output cap 108 cannot be rotated clockwise, it is rotated counter-clockwise as far as it will go, to actuate toggle member 64, and then rotated clockwise as far as it will go, as mentioned above. From this clockwise position the output cap 108 can be held and the slot 118 moved clockwise to the smaller desired oscillating angle.

Movement of slot 118 rotates shaft 116 and flat paddle 114 as before, to force the tapered outer ends 15 and angular holding pointer 61, over the serrations 13 and 59, respectively, to the new angular setting.

Figure 7:
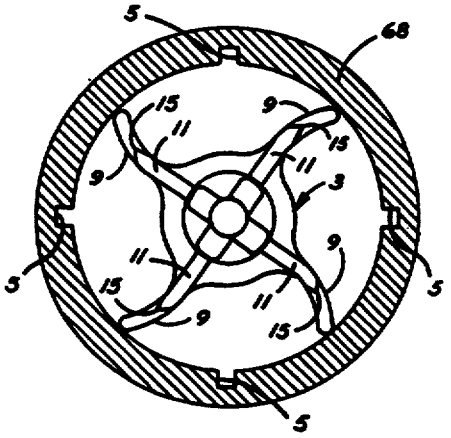
FIG. 7 is a view of the angular positioning member after its legs have become disengaged from grooves located in the cooperating cylindrical member.

In the setting of the oscillating angle by turning the setting shaft 116, if the motion of cylindrical member 68 is restricted and the setting shaft 116 turned with excessive force, the vane members 9 will bend out of grooves 5, preventing any breakage by forcing setting shaft 116 (see FIG. 7). The material and thickness of the vanes 9 can be controlled to achieve a desired torque at which vanes 9 will be bent out of grooves 5 which will limit the torque placed on all other related operating parts.

The output cap 108 can have its oscillating motion connected to a device requiring an oscillating input by a gear meshing with gear teeth 120. Other drive means can be used, such as pullies.

If it is desired to use the transmission device 1 as an oscillating sprinkler head, a liquid such as water, can drive a turbine connected to input shaft 12 and then be directed into opening 95. From opening 95 the liquid will pass through the smaller cylindrical section 68A where it enters the larger part of cylindrical member 68 between the four spaced vane members 9. The liquid then flows past individual projections 11 around shaft 116 in the lower cooperating cylindrical portion 51B of cylindrical shaft member 51 into the upper Hollow output shaft portion 51A and into the output cap 108. The liquid is directed outwardly from the output cap 108 through the oscillating nozzle opening 122.

Figure 11:
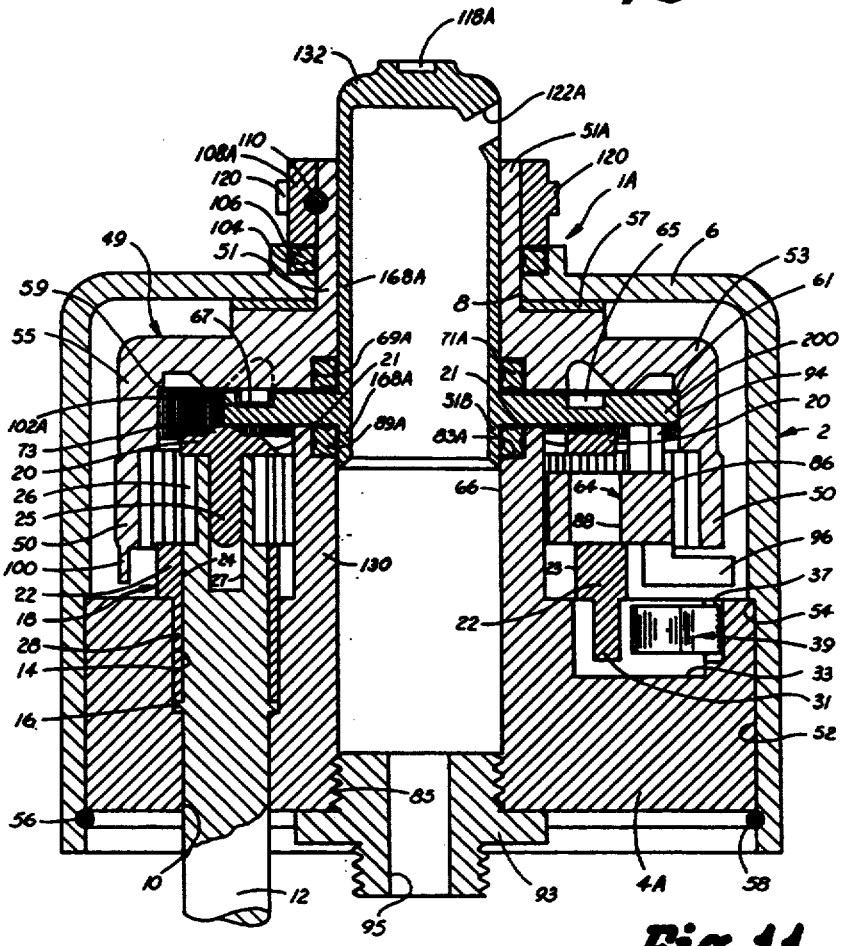
FIG. 11 is an elevational view in section of a modification of the transmission device as shown in FIG. 1.

The modified transmission device 1A of FIG. 11 has the same rotary input shaft 12 and oscillating ring gear 50, with intermediate oscillating drive, as shown in FIG. 1 and described above, as can be seen from a comparison of the Figures. The basic difference is the simplification of the mechanism to set the desired oscillating angle between fixed projection 100 and adjustable radial projection 200.

In FIG. 11, the center upstanding cylindrical member 130 of base member 4A physically replaces the cylindrical member 68 and 68A and related annular seal ring 89 and seal retaining ring 91, for supporting and sealing remaining annular flange 102A. Removed along with cylindrical member 68 and 68A, are the angular positioning member 3, the lower cooperating cylindrical portion 51B, the angular positioning shaft 116, and the top of output cap 108 above the upper hollow output shaft portion 51A, leaving member 108A. The connection of pointer 61 of adjustable radial projection 200 to ring gear 50 remains the same.

Added to the modification is a cylindrical member 168A extending into hollow output shaft portion 51A and center cylindrical member 130 for connection to annular flange 102A to mount it for rotation in output ring gear 50 and provide for rotating the flange 102A and adjustable radial projection 200. The connection of adjustable radial projection 200 on flange 102A to ring gear 50 through pointer 61 and serrations 59 is as shown and described for FIG. 1. A top 132 can be placed on the cylindrical member 168A for placing a small adjusting, or setting, slot 118A thereon. If it is desired to use this modification as a sprinkler, the cylindrical member 168A can extend externally of the upper hollow output shaft portion 51A, and have a nozzle opening 122A placed in the side thereof.

An annular groove 83A is placed in the top of center cylindrical member 130 around cylindrical member 168A for receiving a seal 89A, and an annular groove 69A is placed in the output member 49 around cylindrical member 168A for receiving a seal 71A.

It can be seen that this modification provides a simple mounting and setting arrangement for flange 102A and adjustable radial projection 200. To indicate the angular setting of the transmission, an indicating arrowhead is placed on the edge of member 108A indicating the position of fixed projection 100, while an arrowhead is placed on one end of slot 118A indicating the position of angularly adjustable radial projection 200.

The driving operation of this modification is the same as that of FIG. 1, with the angular setting of angularly adjustable radial projection 200 being made simpler, especially with the removal of the angular positioning member 3 and lower cooperating cylindrical portion 51B, which did away with the serrations 13 and cooperating tapered ends 15 on projections 11. Cylindrical member 168A provides the setting function of setting shaft 116 of FIG. 1.

Figure 6:
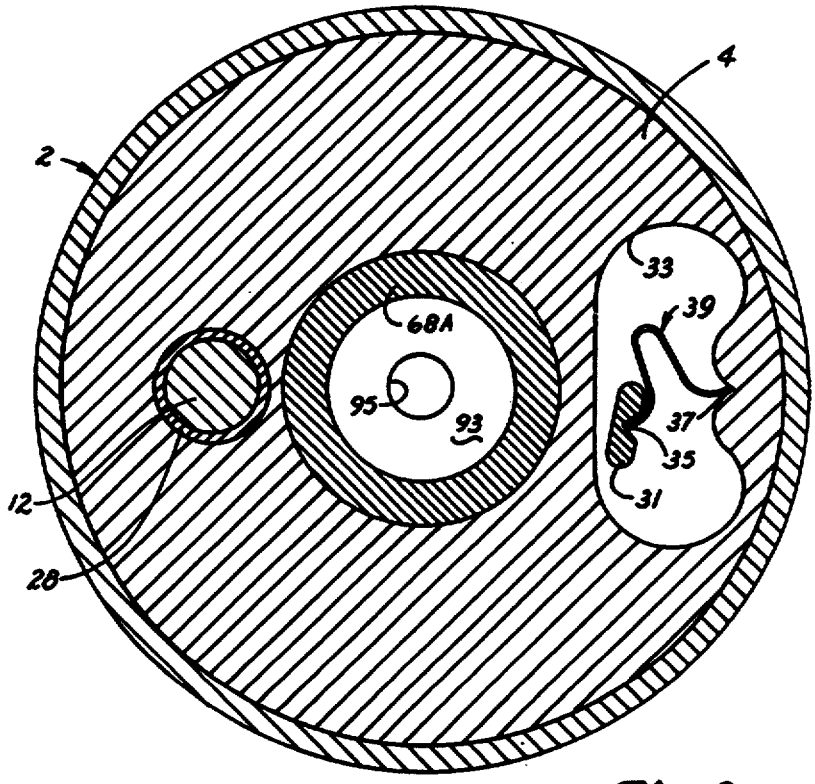
FIG. 6 is a transverse sectional view of the transmission device taken along the line 6—6 of FIG. 1 snowing the overcenter spring means for the reversing gear cage.
Figure 13:
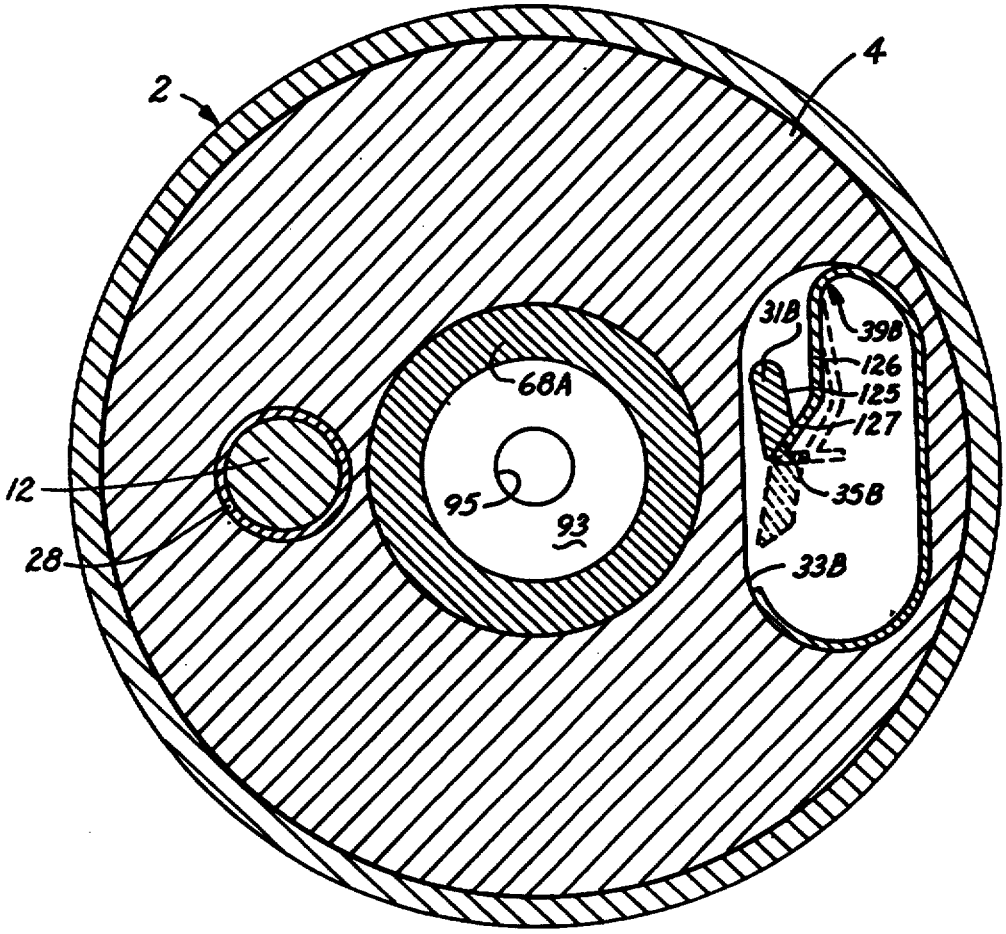
FIG. 13 is a view similar to FIG. 6 showing a modification of the spring means where the gear cage is only directly biased in one direction.

As seen in FIG. 13, to provide for biasing of the gear cage 18 in only one direction, the recess 33B is formed similar to recess 33 of FIG. 6, with spring seat notch 37 removed and the outer wall made straight. A spring member 39B extends around a curved end of recess 33B along the straight outer side and around approximately one-half of the other curved end where it extends into the recess 33B with a straight portion 126 and a portion 127 angled towards the center of the straight inner side of the recess 33B for engaging downwardly projecting member 31B.

In this modification, the downwardly projecting member 31B of the bottom plate 22 of the reversing gear cage 18, is formed as approximately a one-half portion of the projecting member 31 of FIG. 6. The downwardly projecting member 31B has a flat surface 125 perpendicular to a line through the center of input shaft 12, and an angled surface 35B. When the portion 127 rests on the flat surface 125, no biasing force is placed on the gear cage 18 (as shown in phantom in FIG. 13). A biasing force is only placed on the gear cage 18 in one direction when portion 127 contacts the angled surface 35B.

This requirement is to only move the reversing gear cage 18 in one direction back into engagement after the output shaft 51 has manually been turned clockwise externally forcing the teeth of driving gear 44 out of engagement and removing the biasing force through the toggle device 64. This requirement is for a very small angle of gear cage 18 movement clockwise. Other positions of the gear cage 18, outside of the small angle referred to, permit a gear, 34 or 44, of the gear cage 18 to engage the ring gear 60, by biased toggle device 64 or by torque applied by the spur gear 26 to the gear cage 18. Those gear cage 18 locations are between a first position where radial projection 96 has been moved by fixed projection 100 to remove gear 44 from engaging ring gear 50 while removing the biasing toggle force, and a second position where the end of arcuate opening 86 first permits driving gear 34 to engage ring gear 50 for a driving action.

The cam action biasing configuration of FIG. 13 is attractive since it can be designed to be exactly responsive to the small angular biasing requirement with biasing removed when not needed. The bias is applied only during the movement range of 31B that surface 127 is engaging surface 35B.

Another advantage is that the biasing force of this configuration can be designed to remain relatively constant over the movement range that bias is applied. This configuration could, of course, be designed to also provide for bias in the other direction if needed, by putting an angled surface 35B on the other end of downwardly projecting member 31B. The are through which the bias operates can be predetermined by the length of the angled surface 35B.

Figure 14:
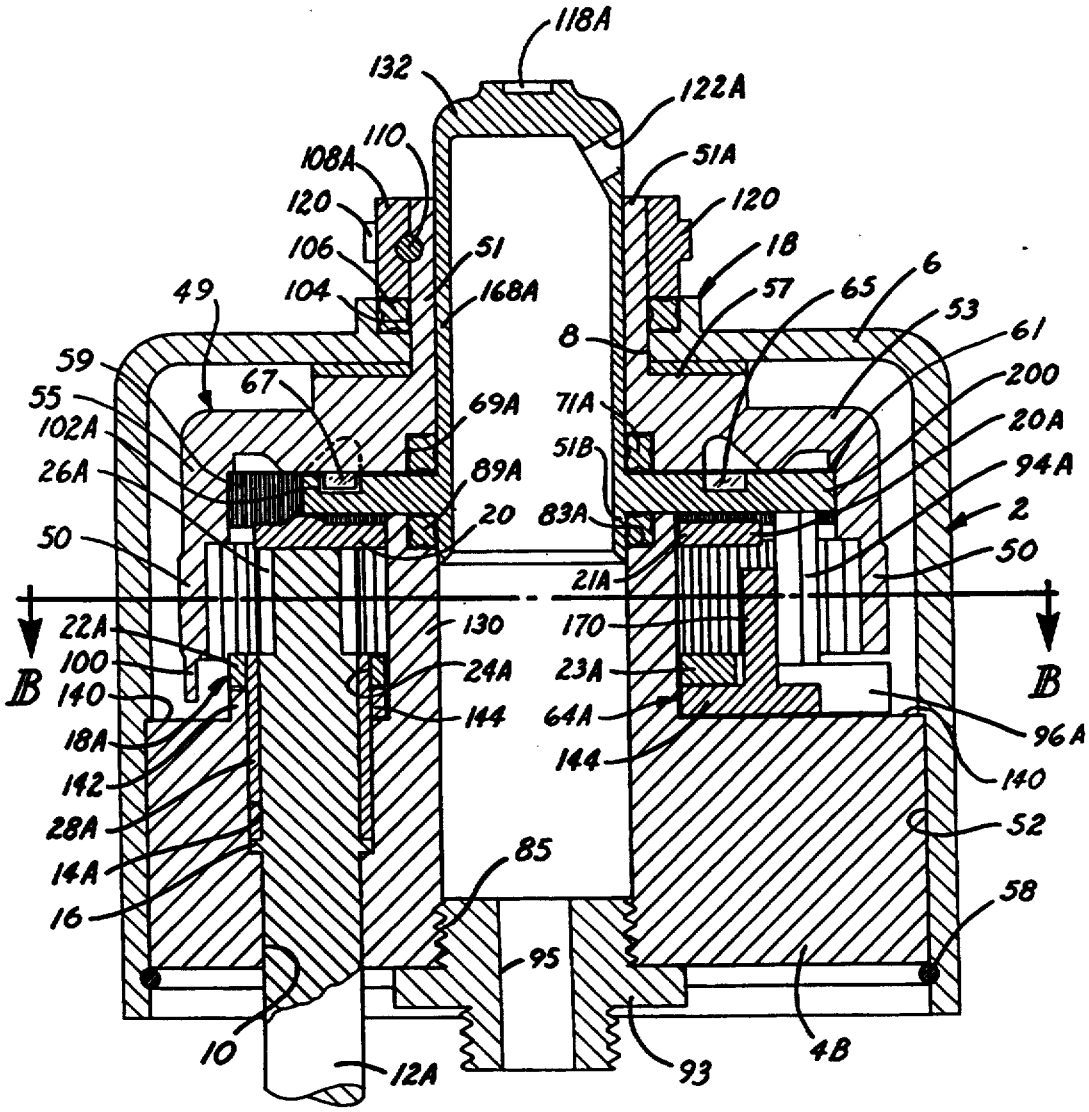
FIG. 14 is an elevational view in section of another modification of the transmission device as shown in FIGS. 1 and 11.

The transmission device 1B of FIG. 14 is a modification of the transmission device 1A of FIG. 11. The drive means between the input shaft 12 and ring gear 50 is changed by (1) replacing the gear cage 18 with a new gear cage 18A; (2) replacing the toggle device 64 with a new toggle device 64A; (3) removing the spring means 39 and cooperating parts, downwardly projecting member 31 and recess 33, for previously maintaining a direct biasing force on gear cage 18 at all times, and (4) placing a bearing sleeve 28A around the top of input shaft 12A.

The base member 4B has the recess 33 removed and presents a flat surface 140 around center upstanding cylindrical member 130, for the toggle member 64A to be located on for oscillating movement around center cylindrical member 130. A raised pad 142 on flat surface 140 is arcuate in shape and is positioned to provide a stop surface at either end, equally spaced from the center of spur gear 26A and rotary input shaft 12A, for toggle device 64A, for a purpose to be hereinafter described. A bearing sleeve 28A is press fitted into enlarged part 14A of opening 10 over annular flange 16 and projects above the raised pad 142 and flat base plate 144 of toggle device 64A to the bottom of the spur gear 26A to provide a stop surface on two sides for gear cage 18A for a purpose to be hereinafter described.

Toggle device 64A comprises the base plate 144 which is substantially circular in shape having an outer cut-out portion 146 to encompass raised pad 142, having cooperating end stop surfaces to have contact with the ends of raised pad 142 to provide a limiting movement between the reversing toggle device 64A and the base member 4B for operation and assembly. Base plate 144 has two opposed inner cut-out portions 148 and 150, opening to the outer surface of cylindrical member 130. The outer surface of cylindrical member 130 has diametrically opposed spring seat notches 152 and 154; spring seat notch 152 faces cut-out portion 148 and spring seat notch 154 faces cut-out portion 150. The outer portion of cut-out portion 148 has a spring seat 156 and the outer portion of cut-out portion 150 has a spring seat 158, said spring seats 156 and 158 being diametrically opposed and spaced equidistant from spring seats 152 and 154, respectively.

Figure 15:
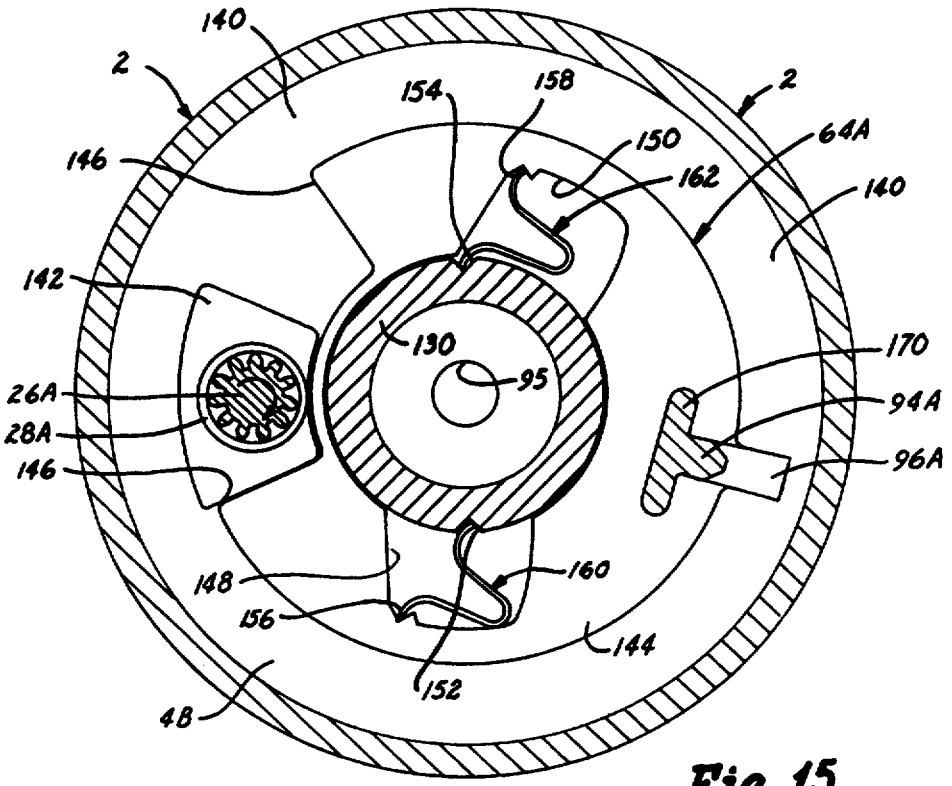
FIG. 15 is a transverse sectional view of the transmission device taken along a plane represented by line B—B of FIG. 14 with the ring gear and reversing gear cage removed, showing the reversing toggle device.

An overcenter spring means 160 extends between spring seat notch 156 on reversing toggle device 64A and spring seat notch 152 on base cylindrical member 130, and a cooperating overcenter spring means 162 extends between spring seat notch 158 on reversing toggle device 64A and spring seat notch 154 on base cylindrical member 130. Spring means 160 and 162 bias reversing toggle device 64A in a clockwise direction as viewed in FIGS. 15 and 16, and in a counter-clockwise direction as viewed in FIG. 18. The action of these spring means 160 end 162 reverses when seat notches 156 and 158 pass on either side of a centerline passing through the spring seat notches 152 and 154.

The base plate 144 has an upstanding projection 94A fop rotating said toggle device 64A in a counter-clockwise direction when contacted by the angularly adjustable radial projection 200, and an outwardly extending radial projection 96A for rotating said toggle device 64A in a clockwise direction when contacted by the fixed projection 100. Another projection 170 extends upwardly from plate 144, radially inward of projection 94A and attached thereto, for a purpose to be hereinafter described. Gear cage 18A is formed having a top plate 20A and a bottom plate 22A with cooperating concentric center openings 21A and 23A, respectively, for placing over base cylindrical member 130. Bottom plate 22A rests on the base plate 144 of toggle device 64A. The bottom plate 22A has an elongated opening 24A to receive the rotary input shaft 12A and bearing sleeve 28A, to provide a limiting movement between the gear cage 18A and the base member 4B for operation; this limiting movement being determined by the length of the elongated opening 24A. This distance could limit the travel of the gear teeth of gear 34A or 42A towards engagement with the gear teeth of spur gear 26A. Spur gear 26A extends upwardly from the top of bottom plate 22A to the top plate 20A.

Figure 16:
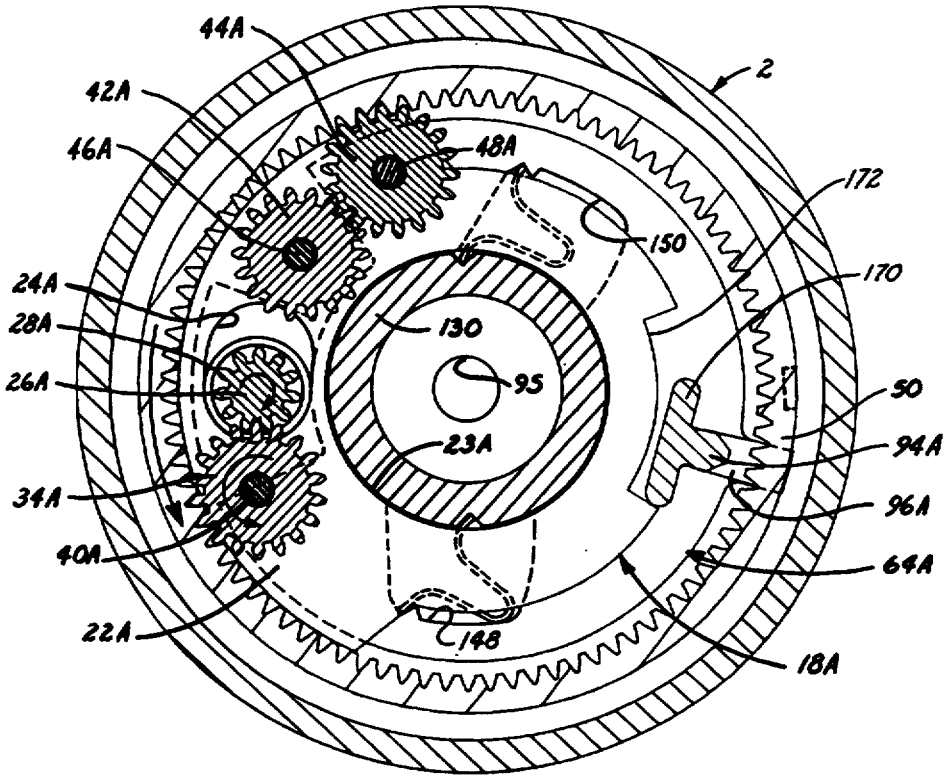
FIG. 16 is a transverse sectional view of the transmission device taken along a plane represented by line B—B of FIG. 14 showing the reversing gear cage and reversing toggle, each biased clockwise with a driving gear engaging the spur gear on the input shaft for driving the ring gear counter-clockwise.
Figure 17:
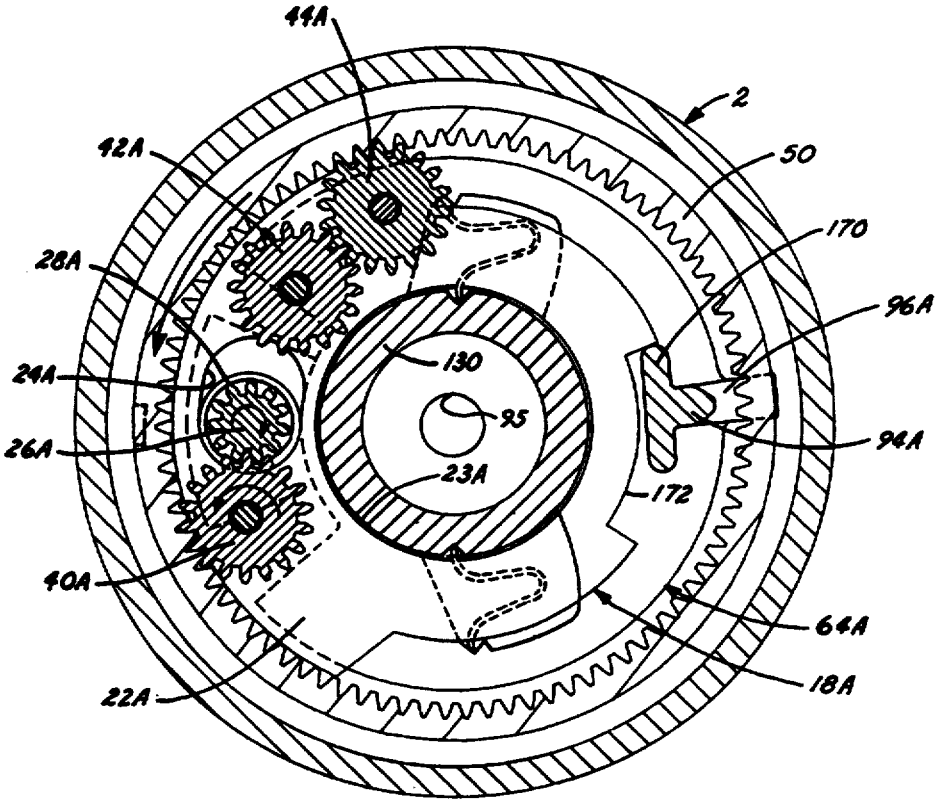
FIG. 17 is a transverse sectional view of the transmission device taken along a plane represented by the line B—B of FIG. 14 showing the reversing toggle forced counter-clockwise to a position where the reversing toggle has just passed over a center line reversing the biasing forces on said reversing toggle.
Figure 18:
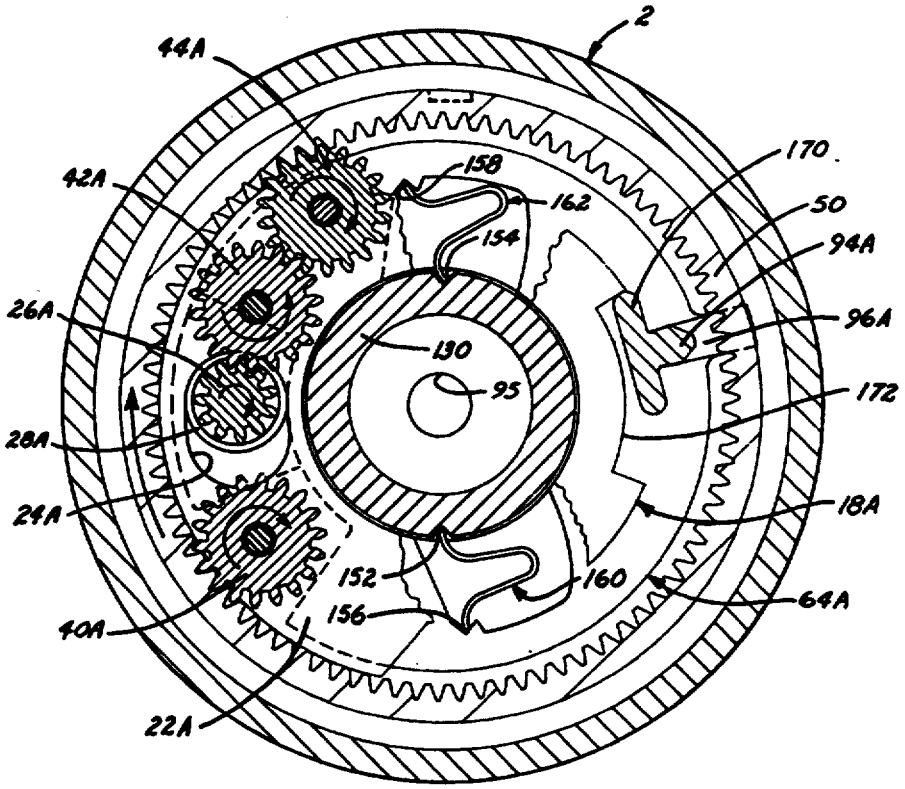
FIG. 18 is a transverse sectional view of the transmission device taken along a plane represented by the line B—B of FIG. 11 showing the reversing gear cage and reversing toggle., each biased counter-clockwise with the other driving gear having its idler gear engaging the spur gear on the input shaft for driving the ring gear clockwise; the gear cage is cut away to show the spring means.

As shown in FIGS. 16, 17, and 18, one gear 34A is mounted on an integral shaft 40A extending downwardly from top plate 20A of reversing gear cage 18A and it is in a counter-clockwise direction from the spur gear 26A. Gear 34A is mounted to extend over the edges of top plate 20A and bottom plate 22A so that it engages output ring gear 50.

Two gears 42A and 44A are mounted on integral shafts 46A and 48A extending downwardly from top plate 20A of the reversing gear cage 18A and they extend in a clockwise direction from the spur gear 26A. Gear 42A is an idler gear and is spaced from gear 34A to permit alternate engagement with spur gear 26A therebetween. Gear 44A is mounted to extend over the edges of top plate 20A and bottom plate 22A so that it engages output ring gear 50. Integral shafts 40A, 46A, and 48A of top plate 20A extend into matched openings in bottom plate 22A and have a snap engagement at their ends.

To provide for the "lost motion" connection of toggle device 64A with respect to rotation of gear cage 18A, an arcuate cut-out 172 is placed on bottom plate 22A to encompass projection 170; the ends of cut-out 172 providing the limits of rotative movement of projection 170, and therefore, relative movement of toggle device 64A with gear cage 18A. Actuating post 60 and arcuate opening 88 provide this "lost motion" connection in the transmission device 1 of FIG. 1, and transmission device 1A of FIG. 11.

In driving operation, input shaft 12A turns clockwise driving output ring gear 50 in an oscillating motion through a predetermined angle set by adjusting slot 118A. This angle is shown as 180° in the Figures. Starting from FIG. 16, drive gear 34A engages spur gear 26A of shaft 12A and drives ring gear 50 counter-clockwise, bringing adjustable radial projection 200 into actuating contact with upstanding projection 94A of toggle device 64A, moving toggle device 64A against spring means 160, 162 past an overcenter position reversing the action of spring means 160, 162. This biases toggle device 64A counter-clockwise for engagement of projection 170 with an end of cut-out 172 of gear cage 18A. Further movement of ring gear 50 by drive gear 34A continues to move radial projection 200 against upstanding projection 94A which begins to pivot the gear cage 18A for disengaging the drive gear 34A. The reversed action of spring means 160, 162 then carries gear cage 18A to its new clockwise driving position (see FIG. 18) where idler gear 42A engages spur gear 26A of shaft 12A which drives drive gear 44A, driving ring gear 50 clockwise; movement of ring gear 50 clockwise bringing fixed projection 100 into actuating contact with radial projection 96A of toggle device 64A, moving toggle device 64A against spring means 160, 162 past an overcenter position, reversing the action of spring means 160, 162. This biases toggle device 64A clockwise for engagement of projection 170 with an end of cut-out 172 of gear cage 18A. Further movement of ring gear 50 by drive gear 44A continues to move fixed projection 100 against radial projection 96A which begins to pivot the gear cage 18A for disengaging drive gear 44A. The reversed action of spring means 160, 162 then carries gear cage 18A back to its counter-clockwise position (see FIG. 16) with drive gear 34A engaging spur gear 26A and driving ring gear 50 counter-clockwise. This oscillation continues as long as input shaft 12A is driven.

I claim:

1. In an oscillating transmission; a ring gear mounted for rotation; means for oscillating said ring gear including actuating means for reversing rotation of said ring gear from one direction to the other, contact means rotated by said ring gear to contact said actuating means to reverse rotation from one direction to the other, said contact means being two contact members, means mounting said two contact members for relative movement to vary the angle at which said actuating means is actuated, one contact member being mounted for rotation by said ring gear, means for mounting the other contact member for rotation within said ring gear, connecting means connecting said other contact member to said ring gear for being driven thereby to contact said actuating means to reverse rotation of said ring gear, said connecting means disconnecting said other contact member from said ring gear when said other contact member is rotated to vary the angle between the other contact member and said one contact member, said other contact member and said actuating means having locking means therebetween providing a locking engagement for preventing movement between said other contact member and said ring gear when said ring gear places said other contact member against said actuating means to drive it.

2. A combination as set forth in claim 1 wherein said locking means between said other contact member and said actuating means includes mating surfaces on said other contact member and said actuating means which maintain said other contact member and ring gear in locking engagement for preventing movement between said other contact member and said ring gear when said ring gear places said other contact member against said actuating means to drive it.

3. In an oscillating transmission; a ring gear mounted for rotation; means for oscillating said ring gear including actuating means for reversing rotation of said ring gear from one direction to the other, contact means rotated by said ring gear to contact said actuating means to reverse rotation from one direction to the other, said contact means being two contact members, means mounting said two contact members for relative movement to vary the angle at which said actuating means is actuated, one contact member being mounted for rotation by said ring gear, means for mounting the other contact member for rotation within said ring gear, connecting means connecting said other contact member to said ring gear for being driven thereby to contact said actuating means to reverse rotation of said ring gear, said connecting means disconnecting said other contact member from said ring gear when said other contact member is rotated to vary the angle between the other contact member and said one contact member, said connecting means providing for movement between said other contact member and said ring gear when said other contact member is rotated with respect to said ring gear.

4. In an oscillating transmission; a ring gear mounted for rotation; means for oscillating said ring gear including actuating means for reversing rotation of said ring gear from one direction to the other, contact means rotated by said ring gear to contact said actuating means to reverse rotation from one direction to the other, said contact means being two contact members, means mounting said two contact members for relative movement to vary the angle at which said actuating means is actuated, one contact member being mounted for rotation by said ring gear, means for mounting the other contact member for rotation within said ring gear, connecting means connecting said other contact member to said ring gear for being driven thereby to contact said actuating means to reverse rotation of said ring gear, said connecting means disconnecting said other contact member from said ring gear when said other contact member is rotated to vary the angle between the other contact member and said one contact member; said ring gear being fixedly mounted on a hollow shaft having an output end, a cap fixed on the output end, shaft means extending through said cap into said hollow shaft engaging said means for mounting the other contact member for rotation within said ring gear to rotate said other contact member.

5. A combination as set forth in claim 4 wherein said shaft means includes an interconnecting member having a torque limiting connection with said means for mounting the other contact member for rotation within said ring gear.

6. A combination as set forth in claim 4 wherein said cap has nozzle means therein, means for directing liquid through said hollow shaft and said nozzle means.

7. A combination as set forth in claim 6 including indicating means providing a visual representation of the predetermined angle at which said nozzle means is set to oscillate through.

8. In an oscillating transmission; a ring gear mounted for rotation, means for oscillating said ring gear including actuating means for reversing rotation of said ring gear from one direction to the other, contact means rotated by said ring gear to contact said actuating means to reverse rotation from one direction to the other, said contact means being two contact members, means mounting said two contact members for relative movement to vary the angle at which said actuating means is actuated, one contact member being mounted for rotation by said ring gear, means for mounting the other contact member for rotation within said ring gear, connecting means connecting, said other contact member to said ring gear for being driven thereby to contact said actuating means to reverse rotation of said ring gear, said connecting means disconnecting said other contact member from said ring gear when said other contact member is rotated to vary the angle between the other contact member and said one contact member; said ring gear being fixedly mounted on a hollow shaft having an output end, cap means rigidly fixed on the output end, shaft means extending through said cap means into said hollow shaft engaging said means for mounting the other contact member for rotation within said ring gear to rotate said other contact member, said cap means having a top surface thereon, said top surface having indicia for indicating the angular movement of said cap means, a first indicating means on said top surface indicates one end of said angular movement while the end of said shaft means which extends through said cap means has a second indicating means for indicating the other end of said angular movement.

9. In an oscillating transmission; a ring gear mounted for rotation; means for oscillating said ring gear including actuating means for reversing rotation of said ring gear from one direction to the other, contact means rotated by said ring gear to contact said actuating means to reverse rotation from one direction to the other, said contact means being two contact members, means mounting said two contact members for relative movement to vary the angle at which said actuating means is actuated, one contact member being mounted for rotation by said ring gear, means for mounting the other contact member for rotation within said ring gear, connecting means connecting said other contact member to said ring gear for being driven thereby to contact said actuating means to reverse rotation of said ring gear, said connecting means disconnecting said other contact member from said ring gear when said other contact member is rotated to vary the angle between the other contact member and said one contact member, said ring gear having an inner cylindrical surface, serration means positioned around said inner cylindrical surface, said other contact member comprising a radial projection means extending from said means for mounting the other contact member, said connecting, means comprising a pointer on said radial projection means engaging a serration of said serration means, movement of said ring gear in one direction driving said radial projection means to contact said actuating means.

10. A combination as set forth in claim 9 wherein said radial projection means and said actuating means have mating surfaces which maintain said pointer in its cooperating serration when said ring gear is driving said radial projection means and said actuating means.

11. In an oscillating transmission; a ring gear mounted for rotation; means for oscillating said ring gear including actuating means for reversing rotation of said ring gear from one direction to the other, contact means rotated by said ring gear to contact said actuating means to reverse rotation from one direction to the other, said contact means being two contact members, means mounting said two contact members for relative movement to vary the angle at which said actuating means is actuated, one contact member being mounted for rotation by said ring gear, means for mounting the other contact member for rotation within said ring gear, connecting means connecting said other contact member to said ring gear for being driven thereby to contact said actuating means to reverse rotation of said ring gear, said connecting means disconnecting said other contact member from said ring gear when said other contact member is rotated to vary the angle between the other contact member and said one contact member, said ring gear having an inner cylindrical surface, serration means positioned around said inner cylindrical surface, said other contact member comprising a radial projection means extending from said means for mounting the other contact member, said connecting means comprising a pointer on said radial projection means engaging a serration of said serration means, movement of said ring gear in one direction driving said radial projection means to contact said actuating means, said pointer being movable over said serrations from one to the other for disconnecting said other contact member from said ring gear when said other contact member is rotated to vary the angle.

12. In an oscillating transmission; a ring gear mounted for rotation; means for oscillating said ring gear including actuating means for reversing rotation of said ring gear from one direction to the other, contact means rotated by said ring gear to contact said actuating means to reverse rotation from one direction to the other, said contact means being two contact members, means mounting said two contact members for relative movement to vary the angle at which said actuating means is actuated, one contact member being mounted for rotation by said ring gear, means for mounting the other contact member for rotation within said ring gear, connecting means connecting said other contact member to said ring gear fox being driven thereby to contact said actuating means to reverse rotation of said ring gear, said connecting means disconnecting said other contact member from said ring gear when said other contact member is rotated to vary the angle between the other contact member and said one contact member, said means for mounting the other contact member for rotation within said ring gear comprising a cylindrical member located radially inwardly from said ring gear, said other contact member being fixed to said cylindrical member and extending radially outwardly therefrom, said other contact member having an outer radial end, said connecting means connecting the outer radial end of said other contact member to said ring gear, said ring gear being fixedly mounted on a hollow shaft, said hollow shaft having an output end, said cylindrical member being mounted for rotation with said hollow shaft.

13. In an oscillating transmission; a ring gear mounted for rotation; means for oscillating said ring gear including actuating means for reversing rotation of said ring gear from one direction to the other, contact means rotated by said ring gear to contact said actuating means to reverse rotation from one direction to the other, said contact means being two contact members, means mounting said two contact members for relative movement to vary the angle at which said actuating means is actuated, one contact member being mounted for rotation by said ring gear, means for mounting the other contact member for rotation within said ring gear, connecting means connecting said other contact member to said ring gear for being driven thereby to contact said actuating means to reverse rotation of said ring gear, said connecting means disconnecting said other contact member from said ring gear when said other contact member is rotated to vary the angle between the other contact member and said one contact member, said means for mounting the other contact member for rotation within said ring gear comprising a cylindrical member, said ring gear being fixedly mounted on a hollow shaft having an output end, said cylindrical member being mounted for rotation with said hollow shaft, said cylindrical member extending through said hollow shaft out of said output end, means for turning said cylindrical member to rotate said other contact member.

14. A combination as set forth in claim 13 wherein the end of said cylindrical member extending out of said output end of said hollow shaft is closed, said cylindrical member having a nozzle opening therein, means for directing a liquid through said cylindrical member to said nozzle opening.

15. A combination as set forth in claim 13 including nozzle means connected to the end of said cylindrical member extending out of said output end of said hollow shaft for angular movement therewith, means for directing a liquid through said cylindrical member to said nozzle means.

16. A combination as set forth in claim 15 including indicating means providing a visual representation of the predetermined angle at which said nozzle means is set to oscillate through.

17. A combination as set forth in claim 16 wherein said indicating means includes indicia movable with said hollow shaft for indicating the angular movement of said nozzle means, a first indicating means connected to said hollow shaft for indicating one end of said angular movement, and a second indicating means connected to said nozzle means for indicating the other end of said angular movement.

18. In an oscillating transmission; a ring gear mounted for rotation; means for oscillating said ring gear including actuating means for reversing rotation of said ring gear from one direction to the other, contact means rotated by said ring gear to contact said actuating means to reverse rotation from one direction to the other, said contact means being two contact members, means mounting said two contact members for relative movement to vary the angle at which said actuating means is actuated, one contact member being mounted for rotation by said ring gear, means for mounting the other contact member for rotation within said ring gear, connecting means connecting said other contact member to said ring gear for being driven thereby to contact said actuating means to reverse rotation of said ring gear, said connecting means disconnecting said other contact member from said ring gear when said other contact member is rotated to vary the angle between the other contact member and said one contact member; said ring gear being fixedly mounted on a hollow shaft having an output end, a cap fixed on the output end, said cap having a nozzle opening therein, means for directing liquid through said hollow shaft to said nozzle opening.

19. In an oscillating transmission; a ring gear mounted for rotation; means for oscillating said ring gear including actuating means for reversing rotation of said ring gear from one direction to the other, contact means rotated by said ring gear to contact said actuating means to reverse rotation from one direction to the other, said contact means being two contact members, means mounting said two contact members for relative movement to vary the angle at which said actuating means is actuated, one contact member being mounted for rotation by said ring gear, means for mounting the other contact member for rotation within said ring gear, connecting means connecting said other contact member to said ring gear for being driven thereby to contact said actuating means to reverse rotation of said ring gear, said connecting means disconnecting said other contact member from said ring gear when said other contact member is rotated to vary the angle between the other contact member and said one contact member, second connecting means connecting said other contact member to said ring gear for being driven thereby to contact said actuating means to reverse rotation of said ring gear, said second connecting means disconnecting said other contact member from said ring gear when said other contact member is rotated to vary the angle between the other contact member and said one contact member.

20. An oscillating transmission comprising; an input shaft means; an output gear means; a pivoted gear cage having two drive gear means thereon, a first clockwise drive gear means and a second counter-clockwise drive gear means for alternate driving engagement with said output gear means to oscillate it; said input shaft means having a gear driving said two drive gear means, said pivoted gear cage being pivotally mounted so that in one position said first clockwise drive gear means drivingly engages said output gear means and in a second position said second counter-clockwise drive gear means drivingly engages said output gear means; a first overcenter spring means for biasing said gear cage to bias one of said drive gear means or the other into driving engagement with said output gear means on either side of a first intermediate position between said driving engagement positions of said drive gear means; toggle means mounted for movement relative to said gear cage between a cooperating first and second limit means on said gear cage, said toggle means including second overcenter spring means for biasing said toggle means against said first or second limit means on said gear cage on either side of a second intermediate position; said first limit means, when biased by said second overcenter spring means through said toggle means, biasing one of said drive gear means of said gear cage into driving engagement with said output gear means along with said first overcenter spring means for rotating said output gear means in one direction; said second limit means, when biased by said second overcenter spring means through said toggle means, biasing the other of said drive gear means of said gear cage into driving engagement with said output gear means along with said first overcenter spring means for rotating said output gear means in the other directions actuating means on said toggle means said output gear means having contact means to contact said actuating means to move said toggle means in one direction over said second intermediate position where the second overcenter spring means will bias said toggle means to its cooperating limit means and then bias the gear cage against the bias of said first overcenter spring means; when the gear cage is moved over said first intermediate position the first overcenter spring means will join the second overcenter spring means and bias said gear cage to driving engagement changing the direction of rotation of said output gear means whereby said contact means of said output gear means will contact said actuating means on said toggle means and move said toggle means in the other direction over said second intermediate position where the second overcenter spring means will bias said toggle means to its other cooperating limit means and then bias the gear cage against the bias of said first overcenter spring means; when the gear cage is moved over said first intermediate position the first overcenter spring means will join the second overcenter spring means and bias said gear cage to driving engagement changing the direction of rotation of said output gear means.

21. An oscillating transmission as set forth in claim 20 wherein said actuating means on said toggle means includes a first actuating contact surface and a second actuating contact surface, said contact means includes a first contact means extending from said output gear means for engaging said second actuating contact surface to move said toggle means in one direction and a second contact means connected to said output gear means for engaging said first actuating contact surface to move said toggle means in the other direction, said first and second contact means being positionable to provide a desired angle of oscillation.

22. An oscillating transmission as set forth in claim 21 wherein one of said contact means is adjustable to vary the angle of oscillation.

23. An oscillating transmission as set forth in claim 22 including means for mounting said second contact means for relative rotation with said output gear means to vary the angle between said first contact means and said second contact means.

24. An oscillating transmission as set forth in claim 23 wherein said second contact means and said first actuating contact surface have a mating engagement when said output gear means drives said second contact means against said first actuating contact surface locking said output gear means to said second contact means.

25. An oscillating transmission as set forth in claim 20 wherein said transmission has a base member, said input shaft means extending through said base member, said gear cage being pivoted around said input shaft means, a projection extending downwardly from the pivoting end of said gear cage for passing through said first intermediate position as said gear cage moves between said driving engagement positions of said drive gear means, a recess formed in said base member under the pivoting end of said gear cage to receive said projection, said recess being sized to permit said projection to swing as the gear cage pivots, first overcenter spring means in said recess for biasing said projection to bias one of said drive gear means or the other into driving engagement with said output gear means.

26. In combination in a transmission, a hollow output shaft having a radial flange with an annular flange extending downwardly therefrom, an internal ring gear formed around the inner surface of said annular flange, serrations formed around the inner surface of said annular flange between said radial flange and said internal ring gear, gear means engaging said internal ring gear for rotating said hollow output shaft in one direction and then in the other direction for oscillation, a toggle device means for changing the direction of rotation of said hollow output shaft at each end of a predetermined angle, said toggle device means having actuating means to move said toggle device means in one direction or the other, means for mounting a cylindrical member for relative concentric rotation with said hollow output shaft, said cylindrical member having one end extending into said annular flange and the other end extending downwardly therefrom, a plurality of longitudinal grooves extending along the length of the interior of said cylindrical member, said one end of said cylindrical member having a first radial projection for contacting said actuating means and moving it in one direction, said radial projection having a pointer engaging one of said serrations, a second projection extending from the end of said annular flange for contacting said actuating means and moving it in the other direction, a connector means connecting said inner surface of said hollow output shaft to the interior of said cylindrical member, said connector means having a centerbody with long vanes projecting radially therefrom for engaging said longitudinal grooves, and means for rotating said connector means which in turn moves said cylindrical member through said long vanes overriding said serrations to vary the angle between the first radial projection and second projection.

27. A combination as set forth in claim 26 including second serrations formed around the inner surface of said hollow output shaft, said connector means having short vanes projecting from said centerbody for engaging said second serrations.

28. A combination as set forth in claim 26 wherein said hollow output shaft has an outer drive portion for oscillation, said drive portion having an outer cap member fixed thereto, said means for rotating said connector means including a shaft with one end connected to said connector means while the other end extends through said outer cap member for actuation.

29. A combination as set forth in claim 28 wherein said outer cap member has a top surface thereon, said top surface having indicia for indicating the angular movement of said outer cap member, a first indicating means on said top surface indicates one end of said annular movement while the end of said shaft which extends through said outer cap member has a second indicating means for indicating the other end of said angular movement.

30. A combination as set forth in claim 28 wherein said output cap member has a nozzle positioned therein for directing a liquid radially therefrom, means for directing a liquid through said cylindrical member and said hollow output shaft into said output cap member.

31. A combination as set forth in claim 26 wherein said long vanes are formed to permit said vanes to bend out of said longitudinal grooves at a predetermined torque to prevent breakage while varying the angle between the first radial projection and second projection.

32. An oscillating transmission having an output gear, a gear cage with two drive gears, a first drive gear and a second drive gear for alternate driving engagement with said output gear to oscillate it, means mounting said gear cage for movement, toggle means for alternately moving said gear cage in one direction to drivingly engage said first drive gear with said output gear or in the other direction to drivingly engage said second drive gear with said output gear, first biasing means for biasing said toggle means and said gear cage in one direction or the other direction, and second biasing means for biasing said gear cage in at least one direction to place and maintain said first drive gear in driving engagement with said output gear when said first means for biasing has been removed.

33. A combination as set forth in claim 32 wherein said second means is also for biasing said gear cage in the other direction to maintain said second drive gear in driving engagement when said first means for biasing has been removed.

34. A combination as set forth in claim 32 including said second means biasing said gear cage in one direction for a predetermined portion of the movement of said first biasing means from said gear cage.

35. A combination as set forth in claim 32 including a downward projection on said gear cage having a surface on which said second biasing means acts, said surface being contoured to vary the effect of the second biasing means.

36. A combination as set forth in claim 32 wherein said gear cage is mounted for an angular movement between driving engagement of said first drive gear and said second drive gear, said first biasing means biasing said gear cage in one direction for one portion of said angular movement and biasing said gear cage in the other direction for another portion of said angular movement, means for removing the biasing of said first biasing means from said gear cage in one direction for reversing movement of said output gear, said second means for biasing said gear cage in one direction maintaining said gear cage biased in said one direction at least until said first biasing means is biasing said gear cage in said other direction.

37. An oscillating transmission having an output gear, said output gear being mounted for rotation in either direction, a gear cage having a first drive gear and a second drive gear for alternately driving said output gear to oscillate said output gear between a first and second angular position, means mounting said gear cage for movement between a first and second drivingly engaged position, toggle means for alternately moving said gear cage in one direction to said first drivingly engaged position to drivingly engage said first drive gear with said output gear to drive said output gear in a direction to its second angular position and in the other direction to said second drivingly engaged position to drivingly engage said second drive gear with said output gear to drive said output gear in a direction to its first angular position, first biasing means for alternately biasing said toggle means and gear cage in one direction to the other toward its first or second drivingly engaged position, means for removing the bias of said first biasing means from said gear cage during the movement of said output gear to its first or second angular position, and second biasing means for directly biasing said gear cage in said one direction towards its first drivingly engaged position to maintain the gear cage biased in said one direction when the bias of said first biasing means has been removed to move said gear cage in said other direction at least until said first biasing means is biasing said gear cage in said other direction.

38. A combination as set forth in claim 37 wherein said second biasing means is also for directly biasing said gear cake in said other direction towards its first drivingly engaged position to maintain said gear cage biased in said other direction when said first biasing means for biasing has been removed to move said gear cage in said one direction until said first biasing means is biasing said gear cage in said one direction.

39. A combination as set forth in claim 37 including a downward projection on said gear cage having a surface on which said second biasing means acts.

40. A combination as set forth in claim 39 wherein said surface is contoured to vary the effect of the second biasing means.

41. In combination in a transmission, a hollow output shaft having a radial flange with an annular flange extending downwardly therefrom, an internal ring gear formed around the inner surface of said annular flange, serrations formed around the inner surface of said annular flange between said radial flange and said internal ring gear, gear means engaging said internal ring gear for rotating said hollow output shaft in one direction and then in the other direction for oscillation, a toggle device means for changing the direction of rotation of said hollow output shaft at each end of a predetermined angle, said toggle device means having actuating means to move said toggle device means in one direction or the other, means for mounting a cylindrical member for concentric rotation with said hollow output shaft, said cylindrical member having one end extending into said annular flange and the other end extending downwardly therefrom, said one end of said cylindrical member having a first radial projection for contacting said actuating means and moving it in one direction, said radial projection having a pointer engaging one of said serrations, a second projection mounted for rotation by said annular flange for contacting said actuating means and moving it in the other direction, a centerbody means connected to the interior of said cylindrical member for rotation therewith, and means for rotating said centerbody means in relation to said hollow output shaft which moves said cylindrical member with said pointer overriding said serrations to vary the predetermined angle between the first radial projection and second projection.

42. In combination in a transmission, a hollow output shaft having a radial flange with an annular flange extending downwardly therefrom, an internal ring gear formed around the inner surface of said annular flange, serrations formed around the inner surface of said hollow output shaft, gear means engaging said internal ring gear for rotating said hollow output shaft in one direction and then in the other direction for oscillation, a toggle device means for changing the direction of rotation of said hollow output shaft at each end of a predetermined angle, said toggle device means having actuating means to move said toggle device means in one direction or the other, means for mounting a cylindrical member for concentric rotation with said hollow output shaft, said cylindrical member having a first radial projection for contacting said actuating means and moving it in one direction, a second projection mounted for rotation by said annular flange for contacting said actuating means and moving it in the other direction, a centerbody means connected to the interior of said cylindrical member below said hollow output shaft for rotation therewith, said centerbody means having short vanes projecting therefrom into said hollow output shaft engaging said serrations, and means for rotating said centerbody means in relation to said hollow output shaft which moves said cylindrical member with said short vanes overriding said serrations to vary the predetermined angle between the first radial projection and second projection.

43. In combination in a transmission, a hollow output shaft having a first inner surface and an outwardly extending radial flange with an annular flange extending downwardly therefrom, said annular flange having a second inner surface, an internal ring gear formed on the inner surface of said annular flange, serrations around one of said inner surfaces, gear means engaging said internal ring gear for rotating said hollow output shaft in one direction and then in the other direction for oscillation, a toggle device means for changing the direction of rotation of said hollow output shaft at each end of a predetermined angle, said toggle device means having actuating means to move said toggle device means in one direction or the other, means for mounting a cylindrical member for concentric rotation with said hollow output shaft, said cylindrical member having a first projection for contacting said actuating means and moving it in one direction, a second projection mounted for rotation by said angular flange for contacting said actuating means and moving it in the other direction, serration engaging means connecting said cylindrical member and first projection to said serrations, means for rotating said cylindrical member and first projection in relation to said hollow output shaft and annular flange to move said serration engaging means to override said serrations to vary the angle between said first projection and said second projection to set them at a predetermined angle.

44. A combination as set forth in claim 43 wherein said serrations are around the inner surface of said annular flange, and said serration engaging means is a pointer on said first projection engaging one of said serrations.

45. A combination as set forth in claim 43 wherein said serrations are around the inner surface of said hollow output shaft, and said serration engaging means is connected to said cylindrical member and has vane means extending into said hollow output shaft engaging said serrations.

46. A combination as set forth in claim 43 wherein said means for rotating said cylindrical member and first projection includes a shaft extending into said hollow output shaft and engaging said cylindrical member to set a predetermined angle between said first projection and said second projection.

47. A combination as set forth in claim 46 including indicating means providing a visual representation of the predetermined angle at which said hollow output shaft is set to oscillate through.

48. A combination as set forth in claim 47 wherein a cap means is rigidly fixed on the hollow output shaft; said cap means having a top surface thereon; said shaft extending through said cap means to said top surface; said indicating means including indicia on said top surface for indicating the angular movement of said cap means, a first indicating means on said top surface indicating one end of said angular movement and a second indicating means on the end of said shaft for indicating the other end of said angular movement.

49. A combination as set forth in claim 48 wherein said cap means has a nozzle opening therein, means for directing liquid through said hollow shaft to said nozzle opening.

50. A combination as set forth in claim 49 wherein said first indicating means on said top surface is aligned with said nozzle opening.

51. An oscillating transmission comprising; an input shaft means; an output gear means; a pivoted gear came having two drive gear means thereon, a first clockwise drive gear means and a second counter-clockwise drive near means for alternate driving engagement with said output gear means to oscillate it; said input shaft means having a gear driving said two drive gear means, said pivoted gear care being pivotally mounted so that in one position said first clockwise drive gear means drivingly engages said output gear means and in a second position said second counter-clockwise drive gear means drivingly engages said output gear means; a first spring means for biasing said gear cage to bias only one of said drive gear means or the other into driving engagement with said output gear means on only one side of a first intermediate position between said driving engagement positions of said drive gear means; toggle means mounted for movement relative to said gear cage between a cooperating first and second limit means on said gear cage, said toggle means including second overcenter spring means for biasing said toggle means against said first or second limit means on said gear cage on either side of a second intermediate position; said first limit means, when biased by said second overcenter spring means through said toggle means, biasing one of said drive gear means of said gear cage into driving engagement with said output gear means along with said first spring means for rotating said output gear means in one direction; said second limit means, when biased by said second overcenter spring means through said toggle means, biasing the other of said drive gear means of said gear cage into driving engagement with said output gear means alone for rotating said output gear means in the other direction; actuating means on said toggle means; said output gear means having contact means to contact said actuating means to move said toggle means in one direction over said second intermediate position where the second overcenter spring means will bias said toggle means to its cooperating limit means and then bias the gear cage against the bias of said first spring means; when the gear cage is moved over said first intermediate position the second overcenter spring means will bias said gear cage to driving engagement changing the direction of rotation of said output gear means whereby said contact means of said output gear means will contact said actuating means on said toggle means and move said toggle means in the other direction over said second intermediate position where the second overcenter spring means will bias said toggle means to its other cooperating limit means and then bias the gear cage; when the gear cage is moved over said first intermediate position the first spring means will join the second overcenter spring means and bias said gear cage to driving engagement changing the direction of rotation of said output gear means.

52. An oscillating sprinkler unit, comprising:

a sprinkler head mounted for rotation about a first axis;

a drive motor;

a reversible gear train for drivingly connecting said drive motor for driving said sprinkler head in alternate directions, comprising final drive gear means connected to said sprinkler head, shiftable drive means comprising alternately operable terminal gear means and carrier means for carrying said terminal gear means and shiftable to alternately engageable positions with said final drive gear means for driving said sprinkler head in alternate directions;

shifting arm means pivotally mounted adjacent said carrier means and movable between alternate shifting positions by engagement with shoulder means carried by said final drive gear means, and lost motion means for connecting said shifting arm means with said carrier means for shifting said carrier means between said alternately engageable positions upon movement of said shifting arm means between said alternate shifting positions:

first over-center biasing means for maintaining said carrier means in a selected one of said alternately engageable positions until positively shifted therefrom by said shifting arm means; and second over-center biasing means for maintaining said shifting arm means in a selected one of alternate shifting positions until engagement by said shoulder means.

53. The sprinkler of claim 52 wherein:

said shiftable drive means comprises a drive gear driven by said drive motor and mounted for rotation about a second axis spaced from said first axis;

said carrier means is mounted for pivotal movement about said second axis; and said shifting arm means is mounted for pivotal movement about said first axis.

54. The sprinkler unit of claim 53 wherein:

said carrier means comprises a yoke surrounding said first axis and said lost motion means comprises shoulder means on the opposite side of said first axis from said second axis for alternate engagement with said shifting arm means.

55. The sprinkler unit of claim 54 wherein:

said first over-center means comprises a spring engaging said yoke between said shoulder means.

56. The sprinkler of claim 55 wherein:

said spring comprises a generally U-shaped leaf spring.

57. The sprinkler system of claim 55 wherein:

said first over-center means maintains said terminal gear means in engagement until said said yoke is biased by said second over-center means through said shifting arm means.

58. An oscillating sprinkler unit, comprising:

a sprinkler head mounted for rotation about a first axis;

a drive motor;

a reversible gear train for drivingly connecting said drive motor for driving said sprinkler head in alternate directions, comprising a final drive gear connected to said sprinkler head, shiftable drive means comprising alternately operable terminal gear means and carrier means for carrying said terminal gear means and shiftable to alternately engageable positions with said final drive gear for driving said sprinkler head in alternate directions;

shifting arm means pivotally mounted adjacent said carrier means and movable between alternate shifting positions by engagement with shoulder means carried by said final drive gear means, and lost motion means for providing engagement with said carrier means for shifting said carrier means between said alternately engageable positions upon movement of said shifting arm means between said alternate shifting positions;

first over-center biasing means for maintaining said carrier means in a selected one of said alternately engageable positions until positively shifted therefrom by said shifting arms means and second over-center bias inn means for maintaining said shifting arm means in a selected one of alternate shifting positions until engagement by said shoulder means.

59. The sprinkler of claim 58 wherein:

said shiftable drive means includes a drive gear driven by said drive motor and mounted for rotation about a second axis spaced from said first axis;

said carrier means mounted for pivotal movement about said second axis; and said shifting arm means mounted for pivotal movement about said first axis.

60. The sprinkler unit of claim 59 wherein:

said carrier means comprises a yoke surrounding said first axis and said lost motion means comprises shoulder means on the opposite side of said first axis from said second axis:

said over-center means comprises spring means engaging said yoke between said shoulder means; and said spring means comprises a generally U-shaped leaf spring.

61. The sprinkler system of claim 60 wherein:

said first over-center means maintains said terminal gear means in engagement until said yoke is biased by said second over-center means through said shifting arm means.

62. An oscillating sprinkler unit, comprising:

a housing having a generally cylindrical configuration with a central axis, an inlet at a lower end for attachment to a source of water and an outlet at an upper end;

a sprinkler head mounted at said upper end for rotation about said central axis;

a drive motor mounted in said housing for driving said sprinkler head;

a shiftable gear train comprising terminal drive gear means, including a pair of terminal gears, and an internal gear connected to said sprinkler head, shiftable means for alternatively shifting said terminal gears alternatively into engagement with said internal gear for driving said sprinkler head in alternate directions;

said shiftable gear train comprising a drive shaft driven by said drive motor and a drive gear mounted for rotation about a second axis offset from said first axis;

a pivoting yoke including a carrier mounted for pivotal movement about said second axis;

one of said terminal gears mounted on said carrier on one side of said second axis,, and the other of said terminal gears mounted on said carrier on the other side of said second axis;

a shifting arm means mounted adjacent said yoke for pivotal movement about said first axis to alternate shifting positions by engagement with shoulder means carried by said internal gear;

lost motion means disposed between said shifting arm and said yoke for connecting said shifting arm means to said yoke for shifting said terminal gears to alternately engageable positions;

first over-center biasing means for maintaining said carrier in a selected one of said alternately engageable positions until positively shifted therefrom by said shifting arm means; and second over-center biasing means for maintaining said shifting arm means in a selected one of said alternate shift in positions until engagement by said shoulder means.

63. A sprinkler unit according to claim 62 wherein:

said first over-center biasing means comprises a generally U-shaped spring disposed between said carrier and fixed means on said housing for biasing said carrier to said one of said alternately engageable positions.

64. An oscillating sprinkler unit, comprising:

a sprinkler head mounted for rotation about a first axis;

drive means comprising a carrier and alternately operable terminal gear means on said carrier and shiftable with said carrier to alternately engageable driving positions within said drive means for driving said sprinkler head in alternate directions;

shifting arm means pivotally moveable between alternate shifting positions by shoulder means carried by said drive means for shifting said carrier between said alternately engageable positions; and cam means on said carrier, and follower means slideably engaging said cam means for biasing and retaining said carrier in a selected one of said alternately engageable positions until shifted therefrom by said shifting arm means.

65. The sprinkler unit of claim 64 wherein said cam means comprises a cam lobe and said follower means engages said lobe on opposite sides thereof for biasing and retaining said carrier in a selected one of said alternately engageable positions.

66. The sprinkler of claim 65 wherein said spring biased follower means comprises a generally L-shaped leaf spring.

67. The sprinkler of claim 66 wherein said cam lobe is on said carrier and said spring biased follower means is mounted on adjacent housing structure.

68. The sprinkler of claim 67 wherein said cam lobe is of a substantially symmetrical V-shape; and said spring biased follower means comprises a generally L-shaped leaf spring.

69. The sprinkler of claim 65 wherein said cam lobe is on said carrier and said spring biased follower means is mounted on adjacent housing structure.

70. The sprinkler of claim 69 wherein:

drive means comprises a drive gear driven by a drive motor and mounted for rotation about a second axis spaced from said first axis;

said carrier is mounted for pivotal movement about said second axis; and said shifting arm means is mounted for pivotal movement about said first axis.

71. The sprinkler unit of claim 70 wherein:

said carrier comprises a yoke surrounding said first axis and said shifting arm means engages said carrier through lost motion means comprising shoulder means on the opposite side of said first axis from said second axis.

72. The sprinkler of claim 65 wherein said cam lobe is of a substantially symmetrical V-shape; and said spring biased follower means comprises a generally L-shaped leaf spring.

73. The sprinkler of claim 64 wherein:

drive means comprises a drive gear driven by a drive motor and mounted for rotation about a second axis spaced from said first axis;

said carrier is mounted for pivotal movement about said second axis; and said shifting arm means is mounted for pivotal movement about said first axis.

74. The sprinkler unit of claim 64 wherein:

said carrier comprises a yoke surrounding said first axis and said shifting arm means engages said carrier through lost motion means comprising shoulder means on the opposite side of said first axis from said second axis.

75. An oscillating sprinkler unit, comprising:

a sprinkler head mounted for rotation about a first axis;

a drive motor;

a reversible gear train for drivingly connecting said drive motor to said sprinkler head for driving said sprinkler head in alternate directions, comprising a final drive gear connected to said sprinkler head shiftable drive means comprising a carrier and alternately operable terminal gear means on said carrier shiftable with said carrier to alternately engageable positions with said final drive gear for driving said sprinkler head in alternate directions;

shifting arm means pivotally mounted adjacent said carrier and moveable between alternate shifting positions by engagement with shoulder means carried by said gear train, and lost motion means for connecting said shifting arm means with said carrier for shifting said carrier between said alternately engageable positions upon movement of said shifting arm means between said alternate shifting positions; and cam means on said carrier slideably engageable by adjacent biasing follower means for biasing and maintaining said carrier in a selected one of said alternately engageable positions until shifted therefrom by said shifting arm means.

76. The sprinkler unit of claim 75 wherein said cam means comprises a cam lobe and said adjacent biasing follower means comprises spring biased follower means engaging said lobe on opposite sides thereof.

77. The sprinkler of claim 76 wherein said spring biased follower means comprises a generally L-shaped leaf spring.

78. The sprinkler of claim 77 wherein said cam lobe is on said carrier and said L-shaped leaf spring biased is mounted on adjacent housing structure.

79. The sprinkler of claim 76 wherein said cam lobe is on said carrier and said spring biased follower means is mounted on adjacent housing structure.

80. The sprinkler of claim 76 wherein said cam lobe is of a substantially symmetrical V-shape; and said spring biased follower means comprises a generally L-shaped leaf spring.

81. The sprinkler of claim 80 wherein:

reversible gear train comprises a drive gear driven by said drive motor and mounted for rotation about a second axis spaced from said first axis;

said carrier is mounted for pivotal movement about said second axis; and said shifting arm means is mounted for pivotal movement about said first axis.

82. The sprinkler unit of claim 81 wherein:

said carrier comprises a yoke surrounding said first axis and said shifting arm means engages said carrier through said lost motion means comprising shoulder means on the opposite side of said first axis from said second axis.

83. The sprinkler of claim 75 wherein:

said reversible gear train comprises a drive gear driven by said drive motor and mounted for rotation about a second axis spaced from said first axis;

said carrier is mounted for pivotal movement about said second axis; and said shifting arm means is mounted for pivotal movement about said first axis.

84. The sprinkler unit of claim 75 wherein:

said carrier comprises a yoke surrounding said first axis and said shifting arm means engages said carrier through said lost motion means comprising shoulder means on the opposite side of said first axis from said second axis.

85. The sprinkler of claim 84 wherein said cam lobe is of a substantially symmetrical V-shape; and said spring biased follower means comprises a generally L-shaped leaf spring.

86. An oscillating sprinkler unit, comprising:

a housing having a generally cylindrical configuration with a central axis, an inlet at a lower end for attachment to a source of water and an outlet at an upper end;

a sprinkler head mounted at said upper end for rotation about said central axis;

a drive motor mounted in said housing for driving said sprinkler head;

a shiftable gear train comprising terminal drive gear means including an internal gear connected to said sprinkler head, shiftable means for alternatively shifting said terminal drive gear means alternatively into engagement with said internal gear for driving said sprinkler head in alternate directions;

said shiftable drive means comprising a drive shaft driven by said drive motor and operatively connected to a drive gear mounted for rotation about a second axis offset from said first axis;

a pivoting carrier mounted for pivotal movement about said second axis;

one of said terminal gear means mounted on said carrier on one side of said second axis, and the other of said drive gears mounted on said carrier on the other side of said second axis;

a shifting arm mounted adjacent said carrier for pivotal movement about said first axis;

lost motion means disposed between said shifting arm and said carrier for connecting said shifting arm to said carrier for shifting said terminal drive gear means to alternately engageable positions;

first over-center biasing means for maintaining said shifting arm means in a selected one of said alternately shifting positions; and over-center cam means on said carrier slideably engageable by adjacent spring biased follower means for biasing and maintaining said carrier in a selected one of said alternate engageable positions.

87. A sprinkler unit according to claim 86 wherein:

said over-center cam means comprises a dual faced cam and said follower means comprises a generally L-shaped spring disposed between said carrier and said housing for biasing said shifting arm to said one of said alternately shifting positions.

88. The sprinkler of claim 87 wherein said dual faced cam is on said carrier and said spring is mounted on adjacent housing structure.

89. The sprinkler of claim 88 wherein said cam has a lobe that is of a substantially symmetrical V-shape; and said spring comprises a generally L-shaped leaf spring.

90. An oscillating sprinkler unit, comprising:

a sprinkler head mounted for rotation about a first axis;

a drive motor;

a reversible gear train for drivingly connecting said drive motor for driving said sprinkler head in alternate directions, comprising drive gear means connected to said sprinkler head, shiftable drive means comprising alternately operable terminal gear means and carrier means for carrying said terminal gear means, said shiftable drive means being shiftable to alternately engageable positions of said alternatively operable terminal gear means with said drive gear means for driving said sprinkler head in alternate directions;

shifting arm means pivotally mounted adjacent said carrier means and movable between alternate shifting positions by engagement with contact means carried by said drive gear means, and lost motion means for connecting said shifting arm means with said carrier means for shifting said carrier means between said alternately engageable positions upon movement of said shifting arm means between said alternate shifting positions;

first over-center biasing means for maintaining said carrier means in a selected one of said alternately engageable positions until positively shifted therefrom by said shifting arm means; and second over-center biasing means for maintaining said shifting arm means in a selected one of alternate shifting positions until engagement by said contact means.

91. The sprinkler of claim 90 wherein:

said shiftable drive means comprises a drive gear driven by said drive motor and mounted for rotation about a second axis spaced from said first axis;

said carrier means is mounted for pivotal movement about said second axis; and said shifting arm means is mounted for pivotal movement about said first axis.

92. The sprinkler unit of claim 91 wherein:

said carrier means comprises a yoke surrounding said first axis, and said lost motion means comprises contact means on the opposite side of said first axis from said second axis for alternate engagement with said shifting arm means.

93. The sprinkler unit of claim 92 wherein:

said first over-center means comprises a spring engaging said yoke.

94. The sprinkler of claim 93 wherein:

said spring comprises a generally U-shaped leaf spring.

95. The sprinkler system of claim 93 wherein:

said first over-center means maintains said terminal gear means in one of said alternatively operable positions of engagement until said yoke is biased by said second over-center means through said shifting arm means.

96. An oscillating sprinkler unit, comprising:

a sprinkler head mounted for rotation about a first axis;

a drive motor;

a reversible gear train for drivingly connecting said drive motor for driving said sprinkler head in alternate directions, comprising a drive gear connected to said sprinkler head, shiftable drive means comprising alternately operable terminal gear means and carrier means for carrying said terminal gear means, said shiftable drive means being shiftable to alternately engageable positions of said alternatively operable terminal gear means with said drive gear for driving said sprinkler head in alternate directions;

shifting arm means pivotally mounted adjacent said carrier means and movable between alternate shifting positions by engagement with contact means carried by said final drive gear means, and lost motion means for providing engagement with said carrier means for shifting said carrier means between said alternately engageable positions upon movement of said shifting arm means between said alternate shifting positions;

first over-center biasing means for maintaining said carrier means in a selected one of said alternately engageable positions until positively shifted therefrom by said shifting arm means; and second over-center biasing means for maintaining said shifting arm means in a selected one of alternate shifting positions until engagement by said contact means.

97. The sprinkler of claim 96 wherein:

said shiftable drive means includes a drive gear driven by said drive motor and mounted for rotation about a second axis spaced from said first axis;

said carrier means is mounted for pivotal movement about said second axis; and said shifting arm means is mounted for pivotal movement about said first axis.

98. The sprinkler unit of claim 97 wherein:

said carrier means comprises a yoke surrounding said first axis and said lost motion means comprises contact means on the opposite side of said first axis from said second axis;

said over-center means comprises spring means engaging said yoke; and said spring means comprises a generally U-shaped leaf spring.

99. The sprinkler system of claim 98 wherein:

said first over-center means maintains said terminal gear means in engagement until said yoke is biased by said second over-center means through said shifting arm means.

100. An oscillating sprinkler unit, comprising: a sprinkler head mounted for rotation about a first axis; rotating drive means for driving said sprinkler head in alternate directions; drive means including a shiftable carrier for effecting alternately engageable driving positions with said rotating drive means; arc control contact means; shift means pivotally movable by said arc control contact means for initiating movement of said carrier from one of said alternately engageable driving positions toward the other; first biasing means for biasing said shift means and said shiftable carrier means toward one or the other of said driving positions; and second biasing means for biasing said shiftable carrier into driving engagement with at least one of said alternately engageable driving positions independent of said first biasing means.

101. An oscillating sprinkler unit as in claim 100 wherein:

said second biasing means urges said shiftable carrier into one or the other of said alternately engageable driving positions with said rotating drive means until shifted therefrom by said shift means in response to engagement of said shift means by said arc control contact means.

102. An oscillating sprinkler unit as in claim 100 wherein:

each of said first and second biasing means includes over-center spring means.

103. An oscillating sprinkler unit as in claim 100 wherein:

one of said first and second biasing means includes spring means for imposing a load on said shiftable carrier, and the other of said biasing means includes spring means for imposing a load on said shift means.

104. An oscillating transmission having an output gear, a gear cage with two drive gears, a first drive gear and a second drive gear for alternate driving engagement with said output gear to oscillate it, means mounting said gear cage for movement, toggle means for alternately moving said gear cage in one direction to drivingly engage said first drive gear with said output gear or in the other direction to drivingly engage said second drive gear with said output gear, first biasing means connected to said toggle means to impose a biasing load on said toggle means and said gear cage in one direction or the other direction and second biasing means connected to said gear cage to impose a biasing load on said gear cage in one direction or the other direction.

105. An oscillating sprinkler unit as in claim 104 wherein:

each of said first and second biasing means includes over-center spring means.

106. An oscillating sprinkler unit as in claim 104 wherein:

one of said first and second biasing means includes spring means for imposing a load on said shiftable carrier, and the other of said biasing means includes spring means for imposing a load on said shift means.

107. A rotary drive sprinkler device comprising:

a housing for receiving a supply of water;

nozzle head means for directing the flow of water from the sprinkler device, said nozzle head means having a top;

rotatable output shaft means in said housing, said output shaft means being drivingly connected to said nozzle head means;

a drive assembly in said housing for driving said output shaft means;

reversing means within said housing for reversing the direction of rotation of said output shaft means to oscillate said nozzle head means;

actuation means connected to said reversing means for operating said reversing means;

first and second angular limit contact means within said housing for defining a desired angle of oscillation of said nozzle head means, at least one of said contact means being adjustable with respect to the other to set a desired angle of oscillation of said nozzle head means;

said actuation means being responsive to contact with each of said first and second said angular limit contact means to actuate said reversing means to reverse the direction of rotation of said output shaft means;

setting means at the top of said nozzle head means connected to at least one of said angular limit contact means within said housing for changing the relative angular position between said first and second angular limit contact means to increase or decrease the angle of oscillation; and indicator means at the top of said nozzle head means for providing a visual representation of a change in angle of oscillation.

108. A rotary drive sprinkler device as in claim 107 including:

indicating means on the exterior of said nozzle means for indicating the direction the setting means should be moved to increase or decrease the angle of oscillation.

109. A rotary drive sprinkler device as in claim 107 wherein:

said nozzle means has a top surface; and said setting means is located in the center of the top surface.

110. A rotary drive sprinkler device as in claim 107 wherein:

said setting means is directly accessible and actuated from the exterior of said nozzle means.

111. A rotary drive sprinkler device as in claim 107, wherein:

said nozzle means has a top surface; and said setting means and said indicator means are located in the center of said top surface.

112. A rotary drive sprinkler device as in claim 111 wherein:

said setting means forms part of said indicating means.

113. A rotary drive sprinkler device as in claim 107 wherein:

said setting means on the top of said nozzle head means is rotatable; and the degree of rotation of said setting means is equal to the degree of change in angular position between said first and second angular limit contact means.

114. A rotary drive sprinkler device as in claim 107 including:

indicator means on the top of nozzle head means for indicating the position of a nozzle in said nozzle head means.

115. A rotary drive sprinkler device comprising:

a housing for receiving a supply of water;

nozzle head means for directing the flow of water from the sprinkler device, said nozzle head means having a top;

rotatable output shaft means in said housing, said output shaft means being drivingly connected to said nozzle head means;

a drive assembly in said housing for driving said output shaft means;

reversing means within said housing for reversing the direction of rotation of said output shaft means to oscillate said nozzle head means;

actuation means connected to said reversing means for operating said reversing means;

first and second angular limit contact means within said housing for defining a desired angle of oscillation of said nozzle head means, at least one of said contact means being adjustable with respect to the other to set a desired angle of oscillation of said nozzle head means;

said actuating means being responsive to contact with each of said first and second said angular limit contact means to actuate said reversing means to reverse the direction of rotation of said output shaft means;

rotatable setting means in said nozzle head means connected to at least one of said angular limit contact means within said housing for changing the relative angular position between said first and second angular limit contact means to increase or decrease the angle of oscillation by an amount substantially equal to the rotation of said setting means; and said nozzle head means having a top surface and said setting means being at the center of said top surface and being accessible from the exterior of said nozzle.

116. A rotary drive sprinkler device as in claim 115, including:

indicator means on said top surface having indicia representative of changes in the angle of oscillation of said nozzle head means;

said setting means cooperating with said indicia to provide a visual representation of a change in angle of oscillation.

117. A rotary drive sprinkler device as in claim 115 wherein said indicator means includes:

indicia on the exterior of said nozzle means for indicating the direction the setting means should be moved to increase or decrease the angle of oscillation.

118. A rotary drive sprinkler device as in claim 117 wherein:

said setting means includes a slot which cooperates with said indicia to provide a visual representation of a change in angle of oscillation.

119. A rotary drive sprinkler device as in claim 118 wherein:

said setting means is directly accessible and actuated from the exterior of said nozzle means.

120. A rotary drive sprinkler device as in claim 119 wherein:

said setting means forms part of said indicator means.

121. A rotary drive sprinkler device as in claim 117 wherein:

said setting means includes a slot which cooperates with said indicia to provide a visual representation of a change in angle of oscillation.

122. A rotary drive sprinkler device as in claim 115 wherein:

said setting means on the top of said nozzle head means is rotatable; and the degree of rotation of said setting means is equal to the degree of change in angular position between said first and second angular limit contact means.

123. A rotary drive sprinkler device as in claim 115 including:

indicator means on the top of nozzle head means for indicating the position of a nozzle in said nozzle head means.

124. A rotary drive sprinkler device comprising:

a housing for receiving a supply of water;

nozzle head means for directing the flow of water from the sprinkler device, said nozzle head means having a top;

rotatable output shaft means in said housing, said output shaft means being drivingly connected to said nozzle head means;

a drive assembly in said housing for driving said output shaft means;

reversing means within said housing for reversing the direction of rotation of said output shaft means to oscillate said nozzle head means;

actuation means connected to said reversing means for operating said reversing means;

first and second angular limit contact means within said housing for defining a desired angle of oscillation of said nozzle head means, at least one of said contact means being adjustable with respect to the other to set a desired angle of oscillation of said nozzle head means;

said actuation means being responsive to contact with each of said first and second said angular limit contact means to actuate said reversing means to reverse the direction of rotation of said output shaft means;

setting means at the top and center of said nozzle head means connected to at least one of said angular limit contact means within said housing for changing the relative angular position between said first and second angular limit contact means to increase or decrease the angle of oscillation; and indicator means at the top of said nozzle head means for providing a visual representation of the angle of oscillation which has been set.

125. A rotary drive sprinkler device as in claim 124 including:

indicating means on the exterior of said nozzle means for indicating the direction the setting means should be moved to increase or decrease the angle of oscillation.

126. A rotary drive sprinkler device as in claim 124 wherein:

said nozzle means has a top surface; and said setting means is located in the center of the top surface.

127. A rotary drive sprinkler device as in claim 124 wherein:

said setting means is accessible and actuated from the exterior of said nozzle means.

128. A rotary drive sprinkler device as in claim 124 wherein:

said setting means on the top of said nozzle head means is rotatable; and the degree of rotation of said setting means is equal to the degree of change in angular position between said first and second angular limit contact means.

129. A rotary drive sprinkler device as in claim 124 including:

indicator means on the top of nozzle head means for indicating the position of a nozzle in said nozzle head means.

130. A rotary drive sprinkler device as in claim 124 wherein:

said setting means forms part of said indicating means.

131. A rotary drive sprinkler device as in claim 124 wherein said indicator means includes:

indicia on the exterior of said nozzle means for indicating the direction the setting means should be moved to increase or decrease the angle of oscillation.

132. A rotary drive sprinkler device as in claim 131 wherein:

said setting means includes a slot which cooperates with said indicia to provide a visual representation of a change in angle of oscillation.

133. A rotary drive sprinkler device comprising:

a housing for receiving a supply of water;

nozzle head means for directing the flow of water from the sprinkler device, said nozzle head means having a top;

rotatable output shaft means in said housing, said output shaft means being drivingly connected to said nozzle head means;

a drive assembly in said housing for driving said output shaft means;

reversing means within said housing for reversing the direction of rotation of said output shaft means to oscillate said nozzle head means;

actuation means connected to said reversing means for operating said reversing means;

first and second angular limit contact means for defining a desired angle of oscillation of said nozzle head means, at least one of said contact means being adjustable with respect to the other to set a desired angle of oscillation of said nozzle head means;

said actuation means being responsive to contact with each of said first and second said angular limit contact means to actuate said reversing means to reverse the direction of rotation of said output shaft means;

setting means at the top of said nozzle head means for changing the relative angular position between said first and second angular limit contact means to increase or decrease the angle of oscillation, said setting means being above said angular limit contact means and being connected to at least one of said angular limit contact means; and indicator means at the top of said nozzle head means for providing a visual representation of a change in angle of oscillation.

134. A rotary drive sprinkler device as in claim 133 including:

indicating means on the exterior of said nozzle means for indicating the direction the setting means should be moved to increase or decrease the angle of oscillation.

135. A rotary drive sprinkler device as in claim 133 wherein:

said nozzle means has a top surface; and said setting means is located in the center of the top surface.

136. A rotary drive sprinkler device as in claim 133 wherein:

said setting means is directly accessible and actuated from the exterior of said nozzle means.

137. A rotary drive sprinkler device as in claim 133, wherein:

said nozzle means has a top surface; and said setting means and said indicator means are located in the center of said top surface.

138. A rotary drive sprinkler device as in claim 137 wherein:

said setting means forms part of said indicating means.

139. A rotary drive sprinkler device as in claim 133 wherein:

said setting means on the top of said nozzle head means is rotatable; and the degree of rotation of said setting means is equal to the degree of change in angular position between said first and second angular limit contact means.

140. A rotary drive sprinkler device as in claim 133 including:

indicator means on the top of nozzle head means for indicating the position of a nozzle in said nozzle head means.

141. A rotary drive sprinkler device comprising:

a housing for receiving a supply of water;

nozzle head means for directing the flow of water from the sprinkler device, said nozzle head means having a top;

rotatable output shaft means in said housing, said output shaft means being drivingly connected to said nozzle head means;

a drive assembly in said housing for driving said output shaft means;

reversing means within said housing for reversing the direction of rotation of said output shaft means to oscillate said nozzle head means;

actuation means connected to said reversing means for operating said reversing means;

first and second angular limit contact means for defining a desired angle of oscillation of said nozzle head means, at least one of said contact means being adjustable with respect to the other to set a desired angle of oscillation of said nozzle head means;

said actuating means being responsive to contact with each of said first and second said angular limit contact means to actuate said reversing means to reverse the direction of rotation of said output shaft means;

rotatable setting means in said nozzle head means for changing the relative angular position between said first and second angular limit contact means to increase or decrease the angle of oscillation by an amount substantially equal to the rotation of said setting means, said rotatable setting means being above said angular limit contact means and being connected to at least one of said angular limit contact means; and said nozzle head means having a top surface and said setting means being at the center of said top surface and being accessible from the exterior of said nozzle.

142. A rotary drive sprinkler device as in claim 141, including:

indicator means on said top surface having indicia representative of changes in the angle of oscillation of said nozzle head means;

said setting means cooperating with said indicia to provide a visual representation of a change in angle of oscillation.

143. A rotary drive sprinkler device as in claim 141 wherein said indicator means includes:

indicia on the exterior of said nozzle means for indicating the direction the setting means should be moved to increase or decrease the angle of oscillation.

144. A rotary drive sprinkler device as in claim 143 wherein:

said setting means includes a slot which cooperates with said indicia to provide a visual representation of a change in angle of oscillation.

145. A rotary drive sprinkler device as in claim 144 wherein:

said setting means is directly accessible and actuated from the exterior of said nozzle means.

146. A rotary drive sprinkler device as in claim 145 wherein:

said setting means forms part of said indicator means.

147. A rotary drive sprinkler device as in claim 143 wherein:

said setting means includes a slot which cooperates with said indicia to provide a visual representation of a change in angle of oscillation.

148. A rotary drive sprinkler device as in claim 141 wherein:

said setting means on the top of said nozzle head means is rotatable; and the degree of rotation of said setting means is equal to the degree of change in angular position between said first and second angular limit contact means.

149. A rotary drive sprinkler device as in claim 141 including:

indicator means on the top of nozzle head means for indicating the position of a nozzle in said nozzle head means.

150. A rotary drive sprinkler device comprising:

a housing for receiving a supply of water;

nozzle head means for directing the flow of water from the sprinkler device, said nozzle head means having a top;

rotatable output shaft means in said housing, said output shaft means being drivingly connected to said nozzle head means;

a drive assembly in said housing for driving said output shaft means;

reversing means within said housing for reversing the direction of rotation of said output shaft means to oscillate said nozzle head means;

actuation means connected to said reversing means for operating said reversing means;

first and second angular limit contact means for defining a desired angle of oscillation of said nozzle head means, at least one of said contact means being adjustable with respect to the other to set a desired angle of oscillation of said nozzle head means;

said actuation means being responsive to contact with each of said first and second said angular limit contact means to actuate said reversing means to reverse the direction of rotation of said output shaft means;

setting means at the top and center of said nozzle head means for changing the relative angular position between said first and second angular limit contact means to increase or decrease the angle of oscillation, said setting means being above said angular limit contact means and being connected to at least one of said angular limit contact means; and indicator means at the top of said nozzle head means for providing a visual representation of the angle of oscillation which has been set.

151. A rotary drive sprinkler device as in claim 150 including:

indicating means on the exterior of said nozzle means for indicating the direction the setting means should be moved to increase or decrease the angle of oscillation.

152. A rotary drive sprinkler device as in claim 150 wherein:

said nozzle means has a top surface; and said setting means is located in the center of the top surface.

153. A rotary drive sprinkler device as in claim 150 wherein:

said setting means is accessible and actuated from the exterior of said nozzle means.

154. A rotary drive sprinkler device as in claim 150 wherein:

said setting means on the top of said nozzle head means is rotatable; and the degree of rotation of said setting means is equal to the degree of change in angular position between said first and second angular limit contact means.

155. A rotary drive sprinkler device as in claim 150 including:

indicator means on the top of nozzle head means for indicating the position of a nozzle in said nozzle head means.

156. A rotary drive sprinkler device as in claim 150 wherein:

said setting means forms pan of said indicating means.

157. A rotary drive sprinkler device as in claim 150 wherein said indicator means includes:

indicia on the exterior of said nozzle means for indicating the direction the setting means should be moved to increase or decrease the angle of oscillation.

158. A rotary drive sprinkler device as in claim 157 wherein:

said setting means includes a slot which cooperates with said indicia to provide a visual representation of a change in angle of oscillation.

159. An oscillating sprinkler unit, comprising: a sprinkler head mounted for rotation about a first axis; drive means including a shiftable carrier for alternately engageable driving positions with rotating drive means for driving said sprinkler head in alternate directions; shifting arm means pivotally movable by arc control contact means for shifting said carrier towards one or the other of said alternately engageable driving positions; and biasing means for placing said shiftable carrier in driving engagement and for retaining said shiftable carrier in a selected one of said alternately engageable diving positions until shifted therefrom by said shifting arm means.

160. An oscillating sprinkler unit as in claim 159 wherein:

said biasing means retains said shiftable carrier in one or the other of said alternately engageable driving positions with said rotating drive means until shifted therefrom by said shifting arm means in response to engagement of said shifting arm means by said arc control contact means.

161. An oscillating sprinkler unit as in claim 159 wherein:

said biasing means includes over-center spring means.

162. An oscillating sprinkler unit as in claim 159 wherein:

said biasing means includes spring means for imposing a load directly on said shifting arm means.

* * * * *